US007449983B2

(12) United States Patent
Zindler

(10) Patent No.: US 7,449,983 B2
(45) Date of Patent: Nov. 11, 2008

(54) CIRCUIT BREAKER COMMON INTER-PHASE LINK

(75) Inventor: Mark O. Zindler, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 437 days.

(21) Appl. No.: 11/254,509

(22) Filed: Oct. 19, 2005

(65) Prior Publication Data

US 2007/0085641 A1 Apr. 19, 2007

(51) Int. Cl.
*H01H 75/00* (2006.01)
*H01H 9/00* (2006.01)

(52) U.S. Cl. ..... 335/6; 335/11; 335/21; 335/159; 335/160; 335/161; 200/50.32

(58) Field of Classification Search ..... 335/6, 335/8–11, 21, 172, 159–161; 200/50.32
See application file for complete search history.

(56) References Cited

U.S. PATENT DOCUMENTS

| | | | | |
|---|---|---|---|---|
| 3,069,517 | A * | 12/1962 | Cole | 335/9 |
| 3,329,913 | A | 7/1967 | Camp | |
| 6,225,882 | B1 | 5/2001 | Hood et al. | |
| 6,667,680 | B1 | 12/2003 | Gibson et al. | |
| 6,812,422 | B1 | 11/2004 | Slepian | |
| 2004/0130217 | A1 | 7/2004 | Moldovan et al. | |

* cited by examiner

*Primary Examiner*—Ramon M Barrera
(74) *Attorney, Agent, or Firm*—Martin J. Moran

(57) ABSTRACT

An inter-phase link for a shared tripping device, wherein the shared tripping device is structured to operatively couple at least two circuit breakers, and the inter-phase link has an elongated body with a mounting end and a distal end. The inter-phase link body mounting end is structured to be coupled to the primary circuit breaker operating mechanism and the inter-phase link body distal end is structured to extend through a primary circuit breaker housing assembly shaped opening and a secondary circuit breaker housing assembly shaped opening to engage the secondary circuit breaker trip device.

14 Claims, 20 Drawing Sheets

CIRCUIT BREAKER COMMON INTER-PHASE LINK

CROSS-REFERENCE TO RELATED APPLICATIONS

This application is related to commonly assigned, concurrently filed:

U.S. Pat. No. 7,238,909 issued Jul. 3, 2007 "CIRCUIT BREAKER INCLUDING LINE CONDUCTOR HAVING BEND PORTION TO INCREASE CONTACT GAP";

U.S. Pat. No. 7,205,871 issued Apr. 17, 2007 entitled "CIRCUIT BREAKER INTERMEDIATE LATCH";

U.S. Pat. No. 7,202,437 issued Apr. 17, 2007 entitled "ELECTRICAL SWITCHING APPARATUS INCLUDING OPERATING MECHANISM HAVING INSULATING PORTION";

U.S. patent application Ser. No. 11/254,514, filed Oct. 19, 2005, entitled "AUXILIARY SWITCH INCLUDING MOVABLE SLIDER MEMBER AND ELECTRIC POWER APPARATUS EMPLOYING SAME";

U.S. Pat. No. 7,248,135 issued Jul. 24, 2007, entitled "CONTACT ARM WITH 90 DEGREE OFFSET";

U.S. patent application Ser. No. 11/254,535, filed Oct. 19, 2005, entitled "CIRCUIT BREAKER COMMON TRIP LEVER";

U.S. patent application Ser. No. 11/254,515, filed Oct. 19 2005, entitled "CIRCUIT BREAKER INTERMEDIATE LATCH STOP"; and U.S. Pat. No. 7,199,319 issued Apr. 3, 2007, entitled "HANDLE ASSEMBLY HAVING AN INTEGRAL SLIDER THEREFOR AND ELECTRICAL SWITCHING APPARATUS EMPLOYING THE SAME".

BACKGROUND OF THE INVENTION

1. Field of the Invention

The present invention relates to circuit breakers and, more particularly, to a circuit breaker for a telecommunication system having an inter-phase link structured to trip an adjacent circuit breaker.

2. Background Information

Circuit breakers for telecommunication systems typically are smaller than circuit breakers associated with power distribution networks. A typical telecommunication system circuit breaker measures 2.5 inches high by 2.0 inches long by 0.75 inch thick, when the circuit breaker is viewed with the operating handle extending horizontally and moving in a vertical arc. While having a reduced size, the telecommunication system circuit breaker must still accommodate the various components and devices (e.g., separable contacts; trip device; operating mechanism) associated with larger circuit breakers. Thus, while the conventional components of a telecommunication system circuit breaker may not be unique, the necessity of having a reduced size requires specialized configurations and robust components that are different than power distribution circuit breakers. This is especially true where the telecommunication system circuit breakers are used in environments wherein the circuit breaker may be expected to operate for over 10,000 operating cycles and 50 tripping cycles; however, the reduced size telecommunication system circuit breakers are typically limited to a current rating of 30 amps.

The telecommunication system circuit breaker is structured to be disposed in a multi-level rack. The rack has multiple telecommunication system circuit breakers on each level. The rack, preferably, has a spacing between the levels of 1.75 inches; however, the current structure of telecommunication system circuit breakers, as noted above, have a height of 2.5 inches. As such, users have been required to adapt the multi-level rack to accommodate the taller telecommunication system circuit breakers.

Circuit breakers disposed on the rack may be coupled to associated circuits. As such, if the current is interrupted in a first circuit, either due to the circuit breaker tripping or due to a user manually interrupting the circuit, it is sometimes desirable to interrupt the current on an associated second circuit. In the prior art, a common trip bar was structured to trip two adjacent circuit breakers. That is, a single trip bar extended across two circuit breakers and, if an over current condition occurred in either circuit, the actuation of the trip device caused the trip bar to rotate thereby tripping both circuit breakers. In smaller circuit breakers which have a low trip force, the use of a common trip bar is not feasible.

Thus, while existing telecommunication system circuit breakers are small, there is still a need for telecommunication system circuit breakers having a reduced height, especially a telecommunication system circuit breaker having a height of about, or less than, 1.75 inches; the preferred spacing between levels on the rack. As the size of the telecommunication system circuit breakers are reduced further, the need for robust, yet small, components which operate in a reduced space is increased. Accordingly, there is a need for a telecommunication system circuit breaker having a reduced size and an increased operating current range. There is a further need for a common trip device structured to operatively couple two or more telecommunication system circuit breakers having a reduced size.

SUMMARY OF THE INVENTION

These needs, and others, are met by the present invention which provides an inter-phase link structured to operatively couple two or more telecommunication system circuit breakers. The inter-phase link is a component of a shared tripping device that also includes a trip lever. While the inter-phase link may extend through more than two adjacent circuit breakers, the following description shall only address two circuit breakers, a primary circuit breaker and a secondary circuit breaker. This description, however, is not limiting on the claims.

The inter-phase link is an elongated member having a first, mounting end and a second, distal end. The inter-phase link member mounting end is fixedly coupled to the operating mechanism on the primary circuit breaker. As used herein, "fixedly coupled" means that two components so coupled move as one. Thus, when the operating mechanism on the primary circuit breaker moves, the inter-phase link moves as well. The inter-phase link distal end extends beyond the housing assembly of the primary circuit breaker and into the housing assembly of the secondary circuit breaker. Both circuit breaker housing assemblies have openings extending along the path of travel of the inter-phase link.

The secondary circuit breaker has the trip lever. The trip lever also has two ends, a mounting end and a distal end. The trip lever mounting end is pivotally coupled to the circuit breaker and structured to actuate the trip device when the trip lever is actuated. That is, the trip lever distal end extends into the path of travel of the inter-phase link distal end so that, when the inter-phase link moves, the trip lever is actuated.

In this configuration the movement of the primary circuit breaker operating mechanism, due to either tripping or being manually actuated by a user, will cause the inter-phase link to move. When the inter-phase link moves, the inter-phase link distal end engages the trip lever distal end, thereby actuating the trip device of the secondary circuit breaker. When the trip device of the secondary circuit breaker is actuated, the secondary circuit breaker trips, thereby separating the contacts of the secondary circuit breaker. Accordingly, when the primary circuit breaker is in an open position, the secondary circuit breaker is also in an open position.

Just as the operatively coupled circuit breakers are moved into the open position together, it is desirable to move the circuit breakers into the closed position together. Accordingly, the circuit breakers operatively coupled together by an inter-phase link may also include a joined handle. That is, each circuit breaker has a handle member extending from the housing assembly. The handle member moves with the operating mechanism when the circuit breaker is tripped, or moves the operating mechanism when actuated by a user. A handle link may extend between, and be coupled to, the two circuit breaker handles. Thus, when a user moves one handle, to the reset position for example, both circuit breaker operating mechanisms move in tandem.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, directional terms, such as "vertical," "horizontal," "left," "right", "clockwise," etc. relate to the circuit breaker 10 as shown in most of the Figures, that is, with the handle assembly 400 located at the left side of the circuit breaker 10 (FIG. 5), and are not limiting upon the claims.

The present invention is disclosed in association with a telecommunication system circuit breaker 10, although the invention is applicable to a wide range of circuit breakers for a wide range of applications such as but not limited to residential or molded case circuit breakers.

Figure 5:
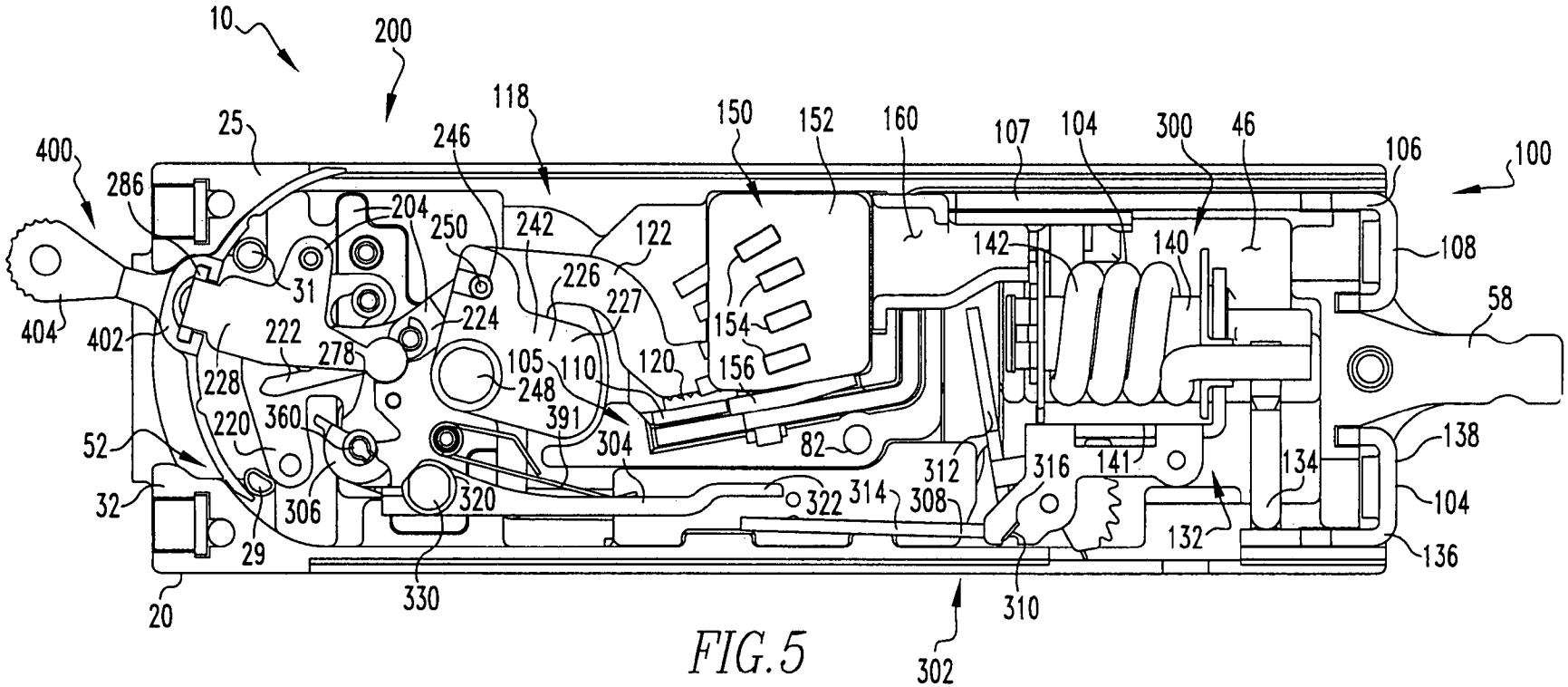
FIG. 5 is a side view of the circuit breaker of FIG. 1 with a housing half shell removed, the operating mechanism cage side plate removed, and showing the circuit breaker in the on position.
Figure 6:
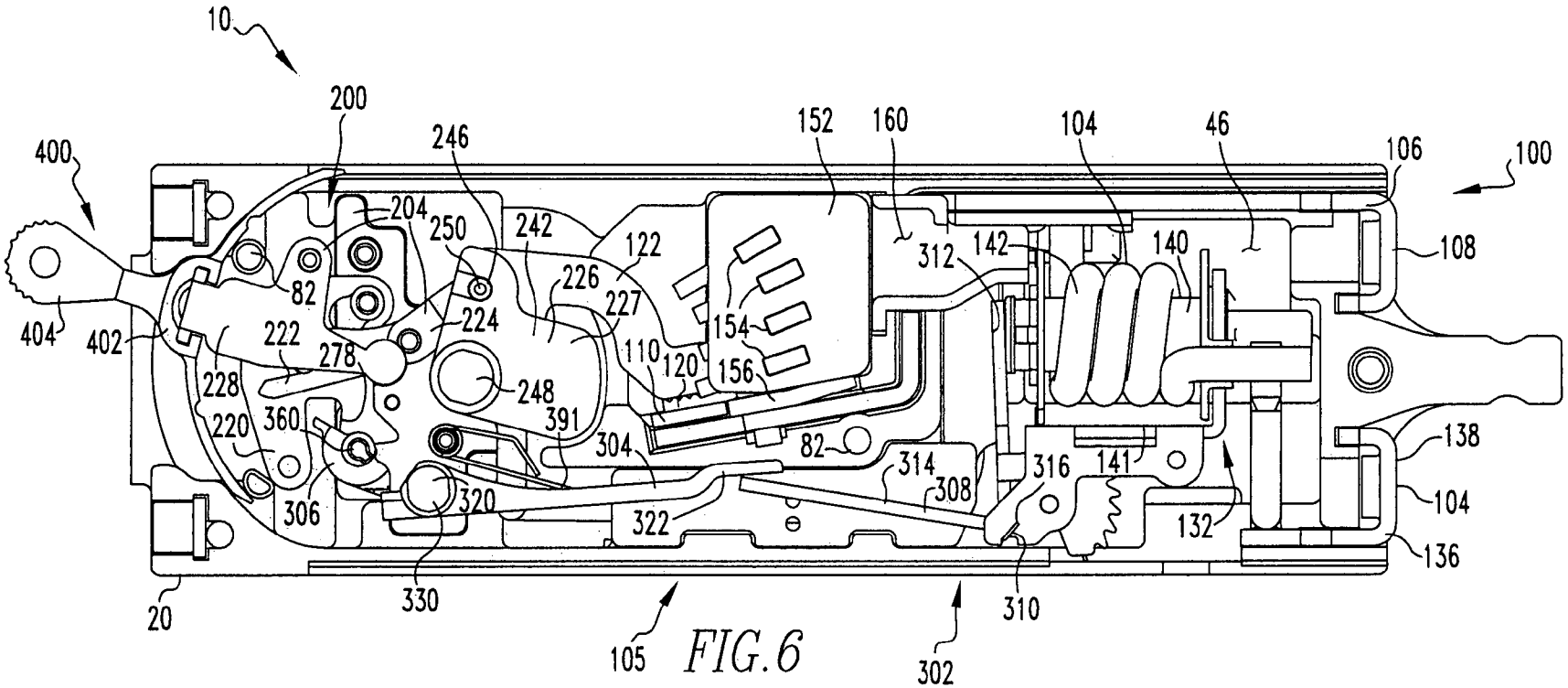
FIG. 6 is a side view of the circuit breaker of FIG. 1 with a housing half shell removed, the operating mechanism cage side plate removed and showing the circuit breaker just after an over current condition occurs.

As shown in FIGS. 1-4, a circuit breaker 10 includes a housing assembly 20, a current path assembly 100 (FIG. 3), an operating mechanism 200, a trip device 300, and a handle assembly 400. Generally, the current path assembly 100 includes a pair of separable contacts 105 (FIG. 3) including a first, fixed contact 100 and a second, movable contact 120. The movable contact 120 is structured to be moved by the operating mechanism 200 between a first, closed position, wherein the contacts 110, 120 are in electrical communication, and a second, open position (FIG. 7), wherein the contacts 110, 120 are separated, thereby preventing electrical communication therebetween. As shown in FIGS. 5-9, the operating mechanism 200 is structured to move between four configurations or positions: a closed position, which is the normal operating position (FIG. 5), a tripped position (FIG. 7), which occurs after an over-current condition, an open position (FIG. 8), which occurs after a user manually actuates and opens the circuit breaker 10, and a reset position (FIG. 9), which repositions certain elements, described below, so that the contacts 110, 120 may be closed. FIG. 6 shows the operating mechanism 200 in a transitional position, just as an over current condition occurs. When the operating mechanism 200 is in the closed position, the contacts 110, 120 are also in the closed position. When the operating mechanism 200 is in the tripped position, the open position, or the reset position, the contacts 110, 120 are in the open position.

The trip device 300 interacts with both the current path assembly 100 and the operating mechanism 200. The trip device 300 is structured to detect an over current condition in the current path assembly 100 and to actuate the operating mechanism 200 to move the contacts 110, 120 from the first, closed position to the second, open position. The handle assembly 400 includes a handle member 404 (described below), which protrudes from the housing assembly 20. The handle assembly 400 further interfaces with the operating mechanism 200 and allows a user to manually actuate the operating mechanism 200 and move the operating mechanism 200 between an on position, an off position, and a reset position.

Figure 1:
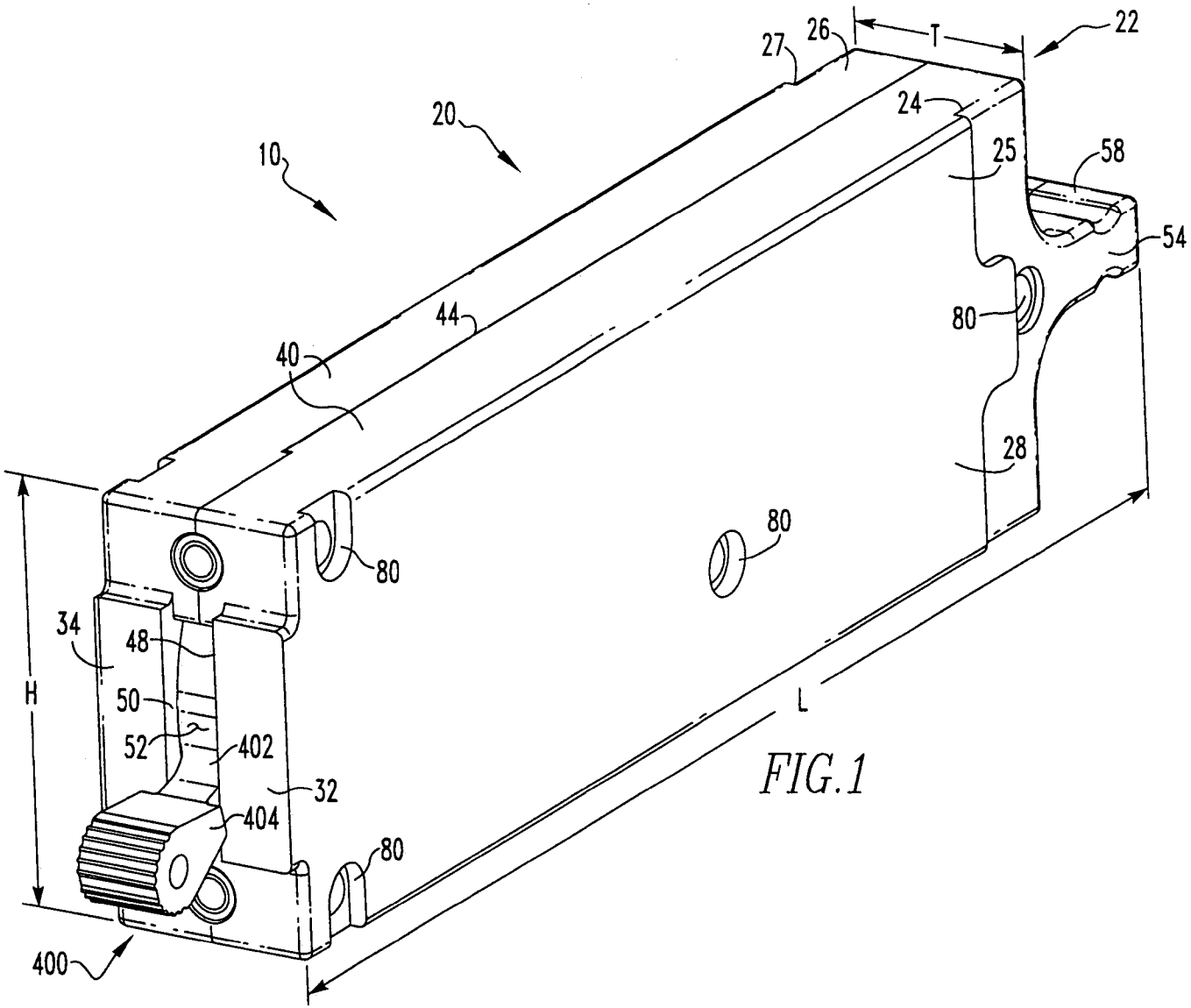
FIG. 1 is an isometric view of a circuit breaker in accordance with the present invention showing the top side.
Figure 2:
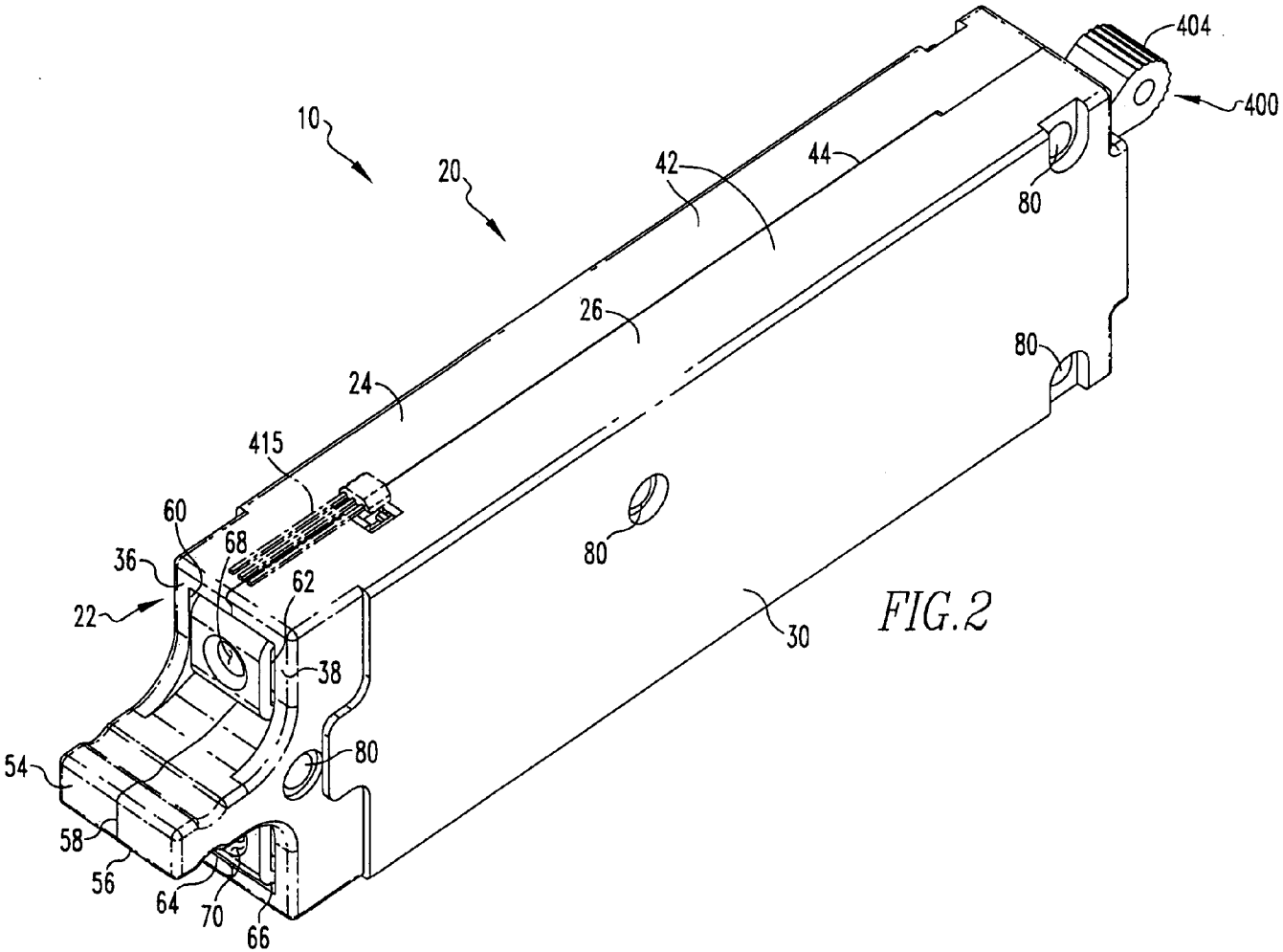
FIG. 2 is an isometric view of the circuit breaker of FIG. 1 showing the bottom side.

As shown in FIGS. 1 and 2, the housing assembly 20 is, generally, made from a non-conductive material. The housing assembly 20 includes a base assembly 22 having a first base member 24 and a second base member 26, a first side plate 28 and a second side plate 30. The housing assembly first side plate 28 may be formed integrally, that is, as one piece, with the housing assembly first base member 24. Similarly, the housing assembly second side plate 30 may be formed integrally with the housing assembly second base member 26. When a housing assembly base member 24, 26 is formed integrally with a housing assembly side plate 28, 30, the combined element may be identified as a housing assembly half shell 25, 27. The housing assembly half shells 25, 27 each have a generally elongated rectangular shape with a top side 32, 34 and a bottom side 36, 38 as well as lateral sides 40, 42. The housing assembly half shells 25, 27 are structured to be coupled together along a generally flat interface 44 thereby forming a substantially enclosed space 46 (FIG. 5). Each half shell top side 32, 34 includes a handle recess 48, 50 along the interface 44. When the two half shells 25, 27 are coupled together, the two recesses 48, 50 form a handle member opening 52. The half shell bottom sides 36, 38 (FIG. 2) each include a central extension 54, 56 disposed generally along the longitudinal axis of the housing assembly 20. The two extensions 54, 56 form a mounting foot 58 structured to engage an optional snap on barrier structured to maintain the spacing between the line and load terminals (not shown). The half shell bottom sides 36, 38 further each include two conductor recesses 60, 62, 64, 66 along the interface 44. When the two half shells 25, 27 are coupled together, the conductor recesses 60, 62, 64, 66 form two conductor openings 68, 70.

The housing assembly 20, preferably, has a length, represented by the letter "L" in FIG. 1, between about 5.0 and 4.0 inches, and more preferably about 4.6inches. The housing assembly 20 also has a height, represented by the letter "H" in FIG. 1, of, preferably, between about 1.75 inches and 1.0 inch, and more preferably about 1.5 inches. Further, housing assembly 20, preferably, has a thickness, represented by the letter "T" in FIG. 1, of between about 1.0 inch and 0.5 inch, and more preferably about 0.75 inch. The two half shells 25, 27 are, preferably, held together by a plurality of rivets (not shown). The two half shells 25, 27 also include a plurality of fastener openings 80.

Within the enclosed space 46 (FIG. 5), each fastener opening 80 may be surrounded by a tubular collar 82. Fasteners, such as, but not limited to, nuts and bolts (not shown), extend through the openings 80 and collars 82 and may be used to couple the two half shells 25, 27 together. The internal components are held in place by the coupling of the half shells 25, 27. The collars 82, preferably, have an extended length so that the fasteners within the fastener openings 80 are substantially separated from the enclosed space 46. As is known in the art, the half shells 25, 27 may have support posts 29, 31 (FIG. 3), pivot pin openings, pockets, and other support structures molded thereon and are structured to support or mount the various other components, such as the operating mechanism 200, within the housing assembly 20. Accordingly, as used herein, when a component is said to be coupled to the housing assembly 20, it is understood that the housing assembly 20 includes an appropriate support post, pivot pin opening, pocket, or other support structure(s) needed to engage the component.

Figure 3:
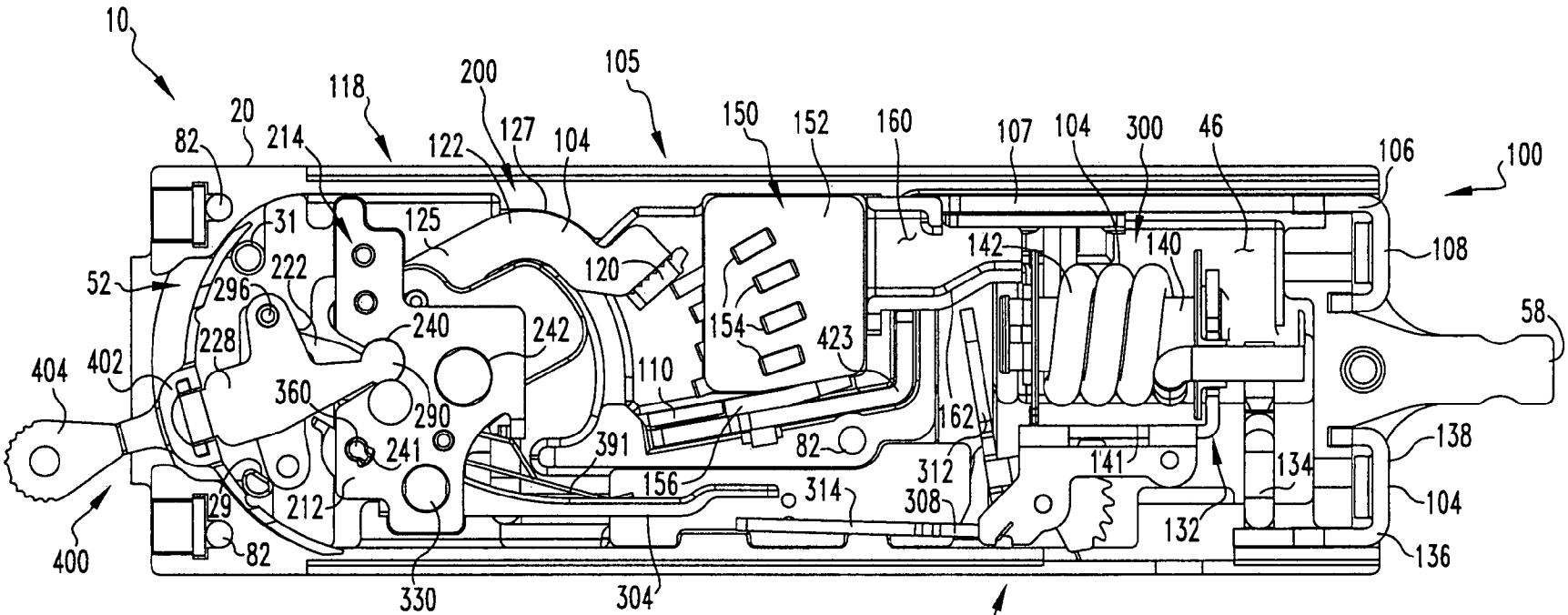
FIG. 3 is a side view of the circuit breaker of FIG. 1 with a housing half shell removed.
Figure 4:
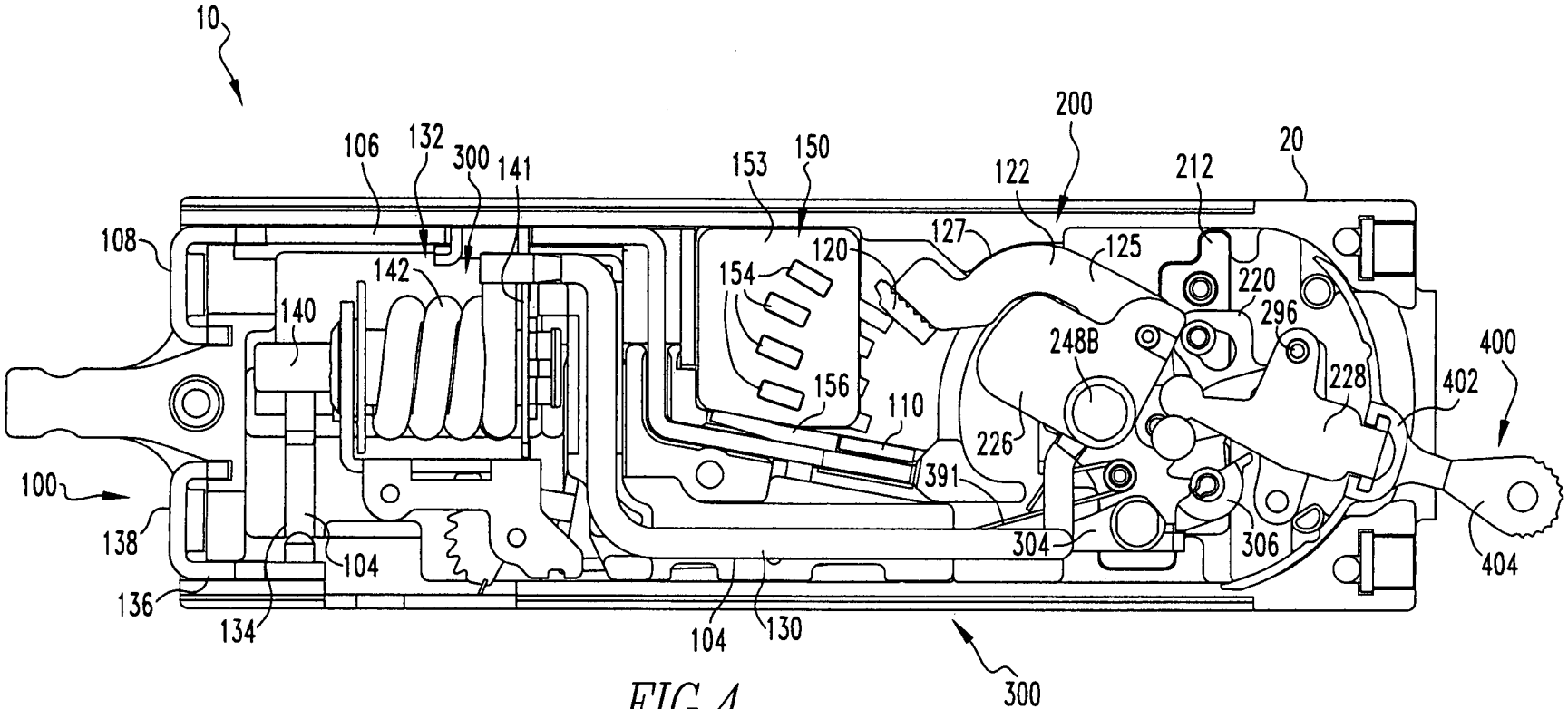
FIG. 4 is a back side view of the circuit breaker of FIG. 1 with a housing half shell removed.
Figure 12:
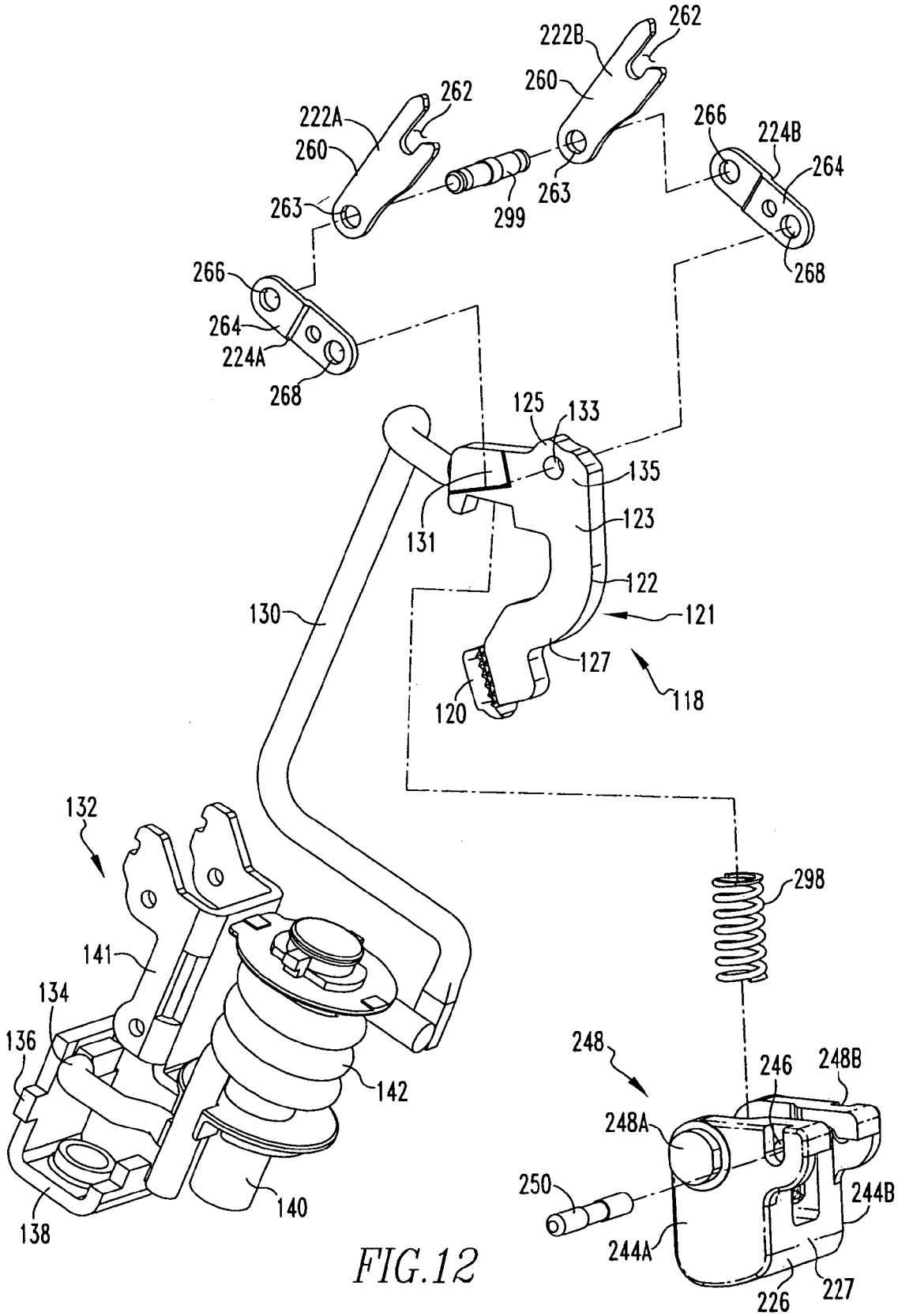
FIG. 12 is an exploded detailed view of a portion of the operating mechanism and a portion of the conductor assembly for the circuit breaker.

As shown in FIGS. 3-4 and 12 the current path assembly 100 is disposed substantially within the housing assembly 20 and includes a plurality of conductive members 104 which are, but for the contacts 110, 120 while in the open position, in electrical communication. As such, current may flow through the circuit breaker 10 so long as the contacts 110,120 are closed. Following a path from the line side of the circuit breaker 10 to the load side of the circuit breaker 10, the conductive members 104 include an elongated line conductor assembly 106 having a line conductor body 107, a line conductor end portion 108 and the fixed contact 110, a movable contact assembly 118 having the movable contact 120 coupled to a moving arm 122, a first shunt 130 (FIG. 4) which is a flexible conductive member such as, but not limited to, a braided wire, a coil assembly 132, a second shunt 134, and a load conductor 136 having a load conductor end portion 138.

Figure 13:
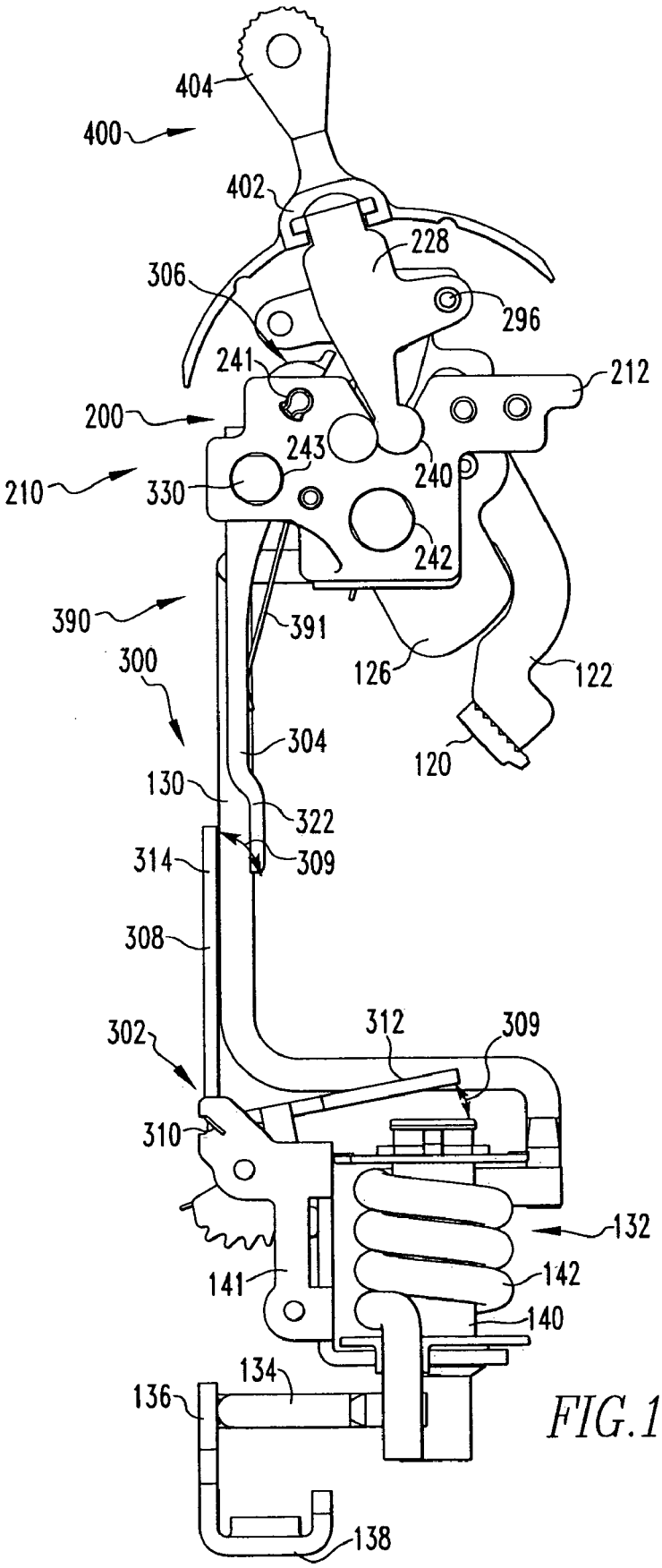
FIG. 13 is a detailed side view of the trip device of FIG. 5 in the tripped position.

As seen in FIG. 12, the moving arm 122 includes an elongated body 123 having a mounting extension 125 located at one end and an offset 121, preferably an arcuate portion 127, disposed at the opposite end. The offset 121 is structured to displace the movable contact 120 relative to the longitudinal axis of the moving arm body 123. The arcuate portion 127, preferably, extends between about 80 to 110 degrees, and more preferably about 90 degrees. The movable contact 120 is disposed at the distal end of the arcuate portion 127. The mounting extension 125 includes a mounting end 131, a central pivot opening 133, and a stop pin end 135. The coil assembly 132 includes a spool 140, a coil assembly frame 141 supporting the spool 140, and a coiled conductor 142 wrapped around the spool 140. As current is passed through the coiled conductor 142 a magnetic field is created as is known in the art. The greater the current passing through the coil assembly 132, the stronger the magnetic field. The coil assembly 132 is sized so that the magnetic field created during an over current condition is sufficient to move the armature assembly armature 308 (FIG. 13). As such, the coil assembly 132 is also an integral part of the trip device 300 (FIG. 5) and may also be described as a part of the trip device 300. The current path assembly I 00 further includes an arc extinguisher assembly 150 that is disposed about the fixed contact 110 and the movable contact 120.

The arc extinguisher assembly 150 includes arc extinguisher side plates 152, 153 within which are positioned spaced-apart generally parallel angularly offset arc chute plates 154 and an arc runner 156. As is known in the art, the function of the arc extinguisher assembly 150 is to receive and dissipate electrical arcs that are created upon separation of the contacts 110, 120 as the contacts 110, 120 are moved from the closed to the open position. The arc extinguisher assembly 150 also includes a gas channel 160 (FIG. 3). The gas channel 160 may be created by a plurality of molded walls extending from any of the two half shells 25, 27, or, preferably, is a separate molded piece 162 structured to be coupled to the two half shells 25, 27. The gas channel 160 is disposed on the side of the arc extinguisher assembly 150 opposite the contacts 110, 120 and is structured to direct arc gases to one or more openings (not shown) in the housing assembly 20.

When installed in the housing assembly 20, the line conductor end portion 108 and the load conductor end portion 138 each extend through one of the conductor openings 68, 70 (FIG. 2). In this configuration, the line conductor end portion 108 and the load conductor end portion 138 may each be coupled to, and in electrical communication with, a power distribution network (not shown). Both the line conductor assembly 106 and the load conductor 136 extend into the enclosed space 46 (FIG. 5). The line conductor assembly 106 is coupled to the housing assembly 20 so that the fixed contact 110 remains substantially stationary. The moving arm 122 is movably coupled to the operating mechanism 200 so that the movable contact 120 may be positioned in contact with the fixed contact 110 (FIG. 5). When the contacts 110, 120 are in the first, closed position, current may flow between the fixed contact 110 and the movable contact 120. The movable contact 120 is further coupled to, and in electrical communication with, one end of the first shunt 130 (FIG. 12). The first shunt 130 extends through the enclosed space 46 so that another end of the first shunt 130 may be, and is, coupled to, and in electrical communication with, the coil assembly 132. The coil assembly 132 is further coupled to, and in electrical communication with, the second shunt 134. The second shunt 134 is also coupled to, and in electrical communication with, the load conductor 136. As such, when the contacts 110, 120 are in the first, closed position, the current path assembly 100 provides a path for current through the circuit breaker 10 including passing through the coil assembly 132 which generates a magnetic field. When in the second position, the contacts 110, 120 are separated by a distance of between about 0.400 and 0.550 inch, and more preferably by about 0.550 inch.

As shown best in FIGS. 5-12, the operating mechanism 200 includes a plurality of rigid members 204 structured to be movable between four configurations or positions: a closed position (FIG. 5), which is the normal operating position; a tripped position (FIG. 7), which occurs after an over-current condition; an open position (FIG. 8), which occurs after a user manually actuates the circuit breaker 10; and a reset position (FIG. 9), which repositions certain members 204, described below, so that the contacts 110, 120 may be closed. In the preferred embodiment, the rigid members 204 are disposed in a generally layered/mirrored configuration. That is, whereas certain members 204 in the central layer are singular elements, other members 204 in the outer layers include two separate elements disposed on either side of the central elements. As set forth below, each member 204 will have a single reference number, however, when necessary to describe a member 204 that is split into two elements, that member's 204 reference number will be followed by either the letter "A" or the letter "B," wherein each letter differentiates between the two separate elements. For example, the operating mechanism 200 includes, preferably, two first links 222A, 222B (FIG. 12). However, when shown in the Figures as a side view, FIG. 10, only a single first link 222 is visible and is identified. The same is true for elements such as, but not limited to, the primary spring 232 and the second link 224 (described below). Similarly, another member 204, such as handle arm 228 (described below) may be said to be coupled to the side plate 212 (described below) and it is understood that, unless otherwise specified, the handle arm 228 is coupled to both side plates 212A, 212B located on either side of the cage 210 (FIG. 3).

The operating mechanism 200 includes the cage 210 (FIG. 3), that is structured to be coupled to the housing assembly 20, a cradle 220 (FIG. 5), the first link 222, the second link 224, a moving arm carrier 226, and a handle arm 228. The operating mechanism 200 also includes a plurality of springs 230 including at least one primary spring 232. The operating mechanism side plate 212 includes a body 213 having a plurality of openings 214. The openings 214 on the side plate 212 include a handle arm opening 240 (FIG. 3) and a moving arm carrier opening 242 (FIG. 3). As seen best in FIG. 12, the moving arm carrier 226 includes a molded body 227 having two lateral side plates 244A, 244B each having an opening 246. A moving arm pivot pin 250 is disposed within the moving arm side plate openings 246 and extends between the moving arm carrier side plates 244A, 244B. The moving arm carrier molded body 227, preferably, acts to direct arc gases away from other circuit breaker 10 components. The moving arm carrier 226 also includes a pivot disk 248 that extends outwardly from each side plate 244A, 244B toward the adjacent housing assembly side plate 28, 30. The first link 222 has a generally elongated body 260 having first and second pivot pin openings 262, 263 at opposing ends. The second link 224 also has a generally elongated body 264 having first and second pivot pin openings 266, 267 at opposing ends. As seen best in FIG. 11, the cradle 220 has a generally planar body 270 having an elongated base portion 272 with a generally perpendicular extension 274. The base portion 272 includes, adjacent to one end, a pivot pin opening 276 and, on the end opposite the pivot pin opening 276, a latch edge 278. The extension 274 has an arced bearing surface 280. The base portion 272 also includes a pivot pin opening 279 and a pivot pin 281 extending therethrough so that the pivot pin 281 extends on each side of the cradle planar body 270, generally perpendicular to the plane of the cradle planar body 270. The pivot pin 281 acts as a pivot for the first links 222A, 222B, as described below. The extension 274 may have an inter-phase link extension 275 having an inter-phase link opening 277. The inter-phase link extension 275 extends toward the latch edge 278 and has a sufficient length to extend beyond the handle arm 228 when the operating mechanism 200 is assembled, as described below.

The handle arm 228 has an inverted, generally U-shaped body 282 with two elongated side plates 284A, 284B and a generally perpendicular bight member 286 extending between the handle arm side plates 284A, 284B. The bight member 286 includes at least one, and preferably two, spring mountings 288A, 288B. Each handle arm side plate 284A, 284B includes a generally circular distal end 290 structured to engage the cage 210 and act as a pivot. Each handle arm side plate 284A, 284B further includes an extension 292 having an opening 294. The handle arm side plate extension 292A, 292B extends generally perpendicular to the longitudinal axis of the associated handle arm side plate 284A, 284B while being in generally the same plane as the side plate 284A, 284B. A cradle reset pin 296 extends between the two handle arm side plate extension openings 294A, 294B.

Figure 11:
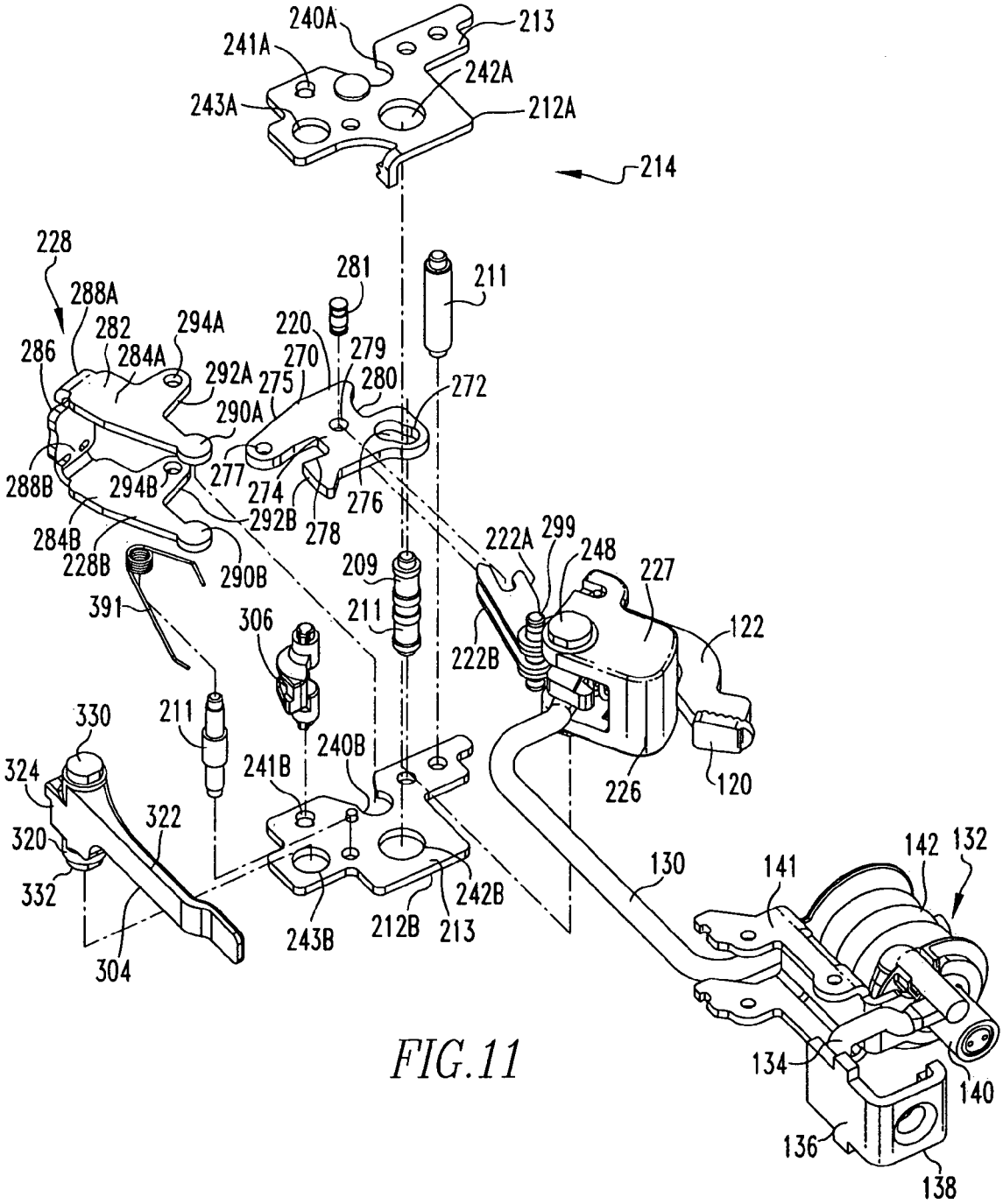
FIG. 11 is a partially exploded view of the operating mechanism of FIG. 10.

The operating mechanism 200 is assembled as follows. The cage 210 (FIG. 3) is coupled to the housing assembly 20, preferably near the handle member opening 52. The handle arm 228 is pivotally coupled to the cage 210 with one handle arm side plate circular distal end 290A, 290B disposed in each cage side plate handle arm opening 240A, 240B. Similarly, the moving arm carrier 226 is pivotally coupled to the cage 210 with one pivot disk 248A, 248B disposed in each moving arm carrier opening 242A, 242B. As noted above, the moving arm pivot pin 250 is disposed within the moving arm carrier openings 242A, 242B and extends between the moving arm carrier side plates 244A, 244B. The moving arm 122 is coupled to the moving arm pivot pin 250 with the moving arm pivot pin 250 extending through the mounting extension central pivot opening 133. The moving arm mounting end 131 extends into the moving arm carrier 226. A moving arm spring 298 may be disposed in the moving arm carrier 226. The moving arm spring 298 is a compression spring contacting the moving arm carrier 226 and biasing the moving arm 122 about the moving arm pivot pin 250 so that the moving arm elongated body 123 contacts the moving arm carrier 226. That is, as shown in FIG. 11, the moving arm spring 298 biases the moving arm mounting end 131 in an upward direction, as shown in FIG. 12, which, in turn, creates a torque about the moving arm pivot pin 250 causing the moving arm elongated body 123 to be biased against the moving arm carrier 226.

The second link 224 is also pivotally coupled to the moving arm pivot pin 250 and extends, generally, toward the handle arm 228. More specifically, the moving arm pivot pin 250 extends through the second link pivot pin opening 264. The second link 224 is also pivotally coupled to the first link 222. More specifically, a link pivot pin 299 extends through the first link second pivot pin opening 263 and the second link first pivot pin opening 266. The first link first pivot pin opening 262, which may be a generally U-shaped slot, is coupled to a cradle body pivot pin 281. The primary spring 232, a tension spring, extends from the handle arm bight member spring mounting 288 to the link pivot pin 299.

In this configuration, the primary spring 232 generally biases the second link 224 and the cradle 220 generally toward the handle member 404, which in turn, biases the moving arm 122 and movable contact 120 to the second, open position. During normal operation with current passing through the circuit breaker 10, the trip device 300 holds the operating mechanism 200 in the closed position. As set forth above, when the operating mechanism 200 is in the closed position, the contacts 110, 120 are in electrical communication. More specifically, during normal operation, the cradle latch edge 278 is engaged by the trip device 300 thereby preventing the bias of the primary spring 232 from moving the operating mechanism 200 into the tripped position. When an over-current condition occurs, the trip device 300 disengages from the cradle latch edge 278 thereby allowing the bias of the primary spring 232 to move the operating mechanism 200 into a tripped position. With the operating mechanism 200 in the tripped position, the contacts 110, 120 are separated.

To return the circuit breaker 10 to the normal operating configuration, a user must move the operating mechanism 200 into the reset position wherein the cradle body latch edge 278 re-engages the trip device 300. That is, when the operating mechanism 200 is in the tripped position, the reset pin 296 is disposed adjacent to the arced bearing surface 280 on the cradle 220. When a user moves the handle assembly 400 (described below and coupled to the handle arm 228) to the reset position, the reset pin 296 engages the arced bearing surface 280 on the cradle 220 and moves the cradle 220 to the reset position as well. In the reset position, the cradle body latch edge 278 moves below, as shown in the figures, the intermediate latch operating mechanism latch 345 (described below) thereby re-engaging the trip device 300.

Once the cradle body latch edge 278 re-engages the trip device 300, the user may move the operating mechanism 200 back to the closed position wherein the contacts 110, 120 are closed. Again, because the trip device 300 in engaged, the bias of the primary spring 232 is resisted and the operating mechanism 200 is maintained in the on position.

Additionally, the user may manually move the operating mechanism 200 to an open position which causes the contacts 110, 120 to be separated without disengaging the trip device 300. When a user moves the handle assembly 400 (described below and coupled to the handle arm 228) to the off position, the direction of the bias primary spring 232, that is the direction of the force created by the primary spring 232, changes so that the second link 224 moves independently of the cradle 220. Thus, the bias of the primary spring 232 causes the moving arm 122 to move away from the fixed contact 110 until the contacts 110, 120 are in the second, open position. As noted above, when the operating mechanism 200 is in the off position, the trip device 300 still engages the cradle 220. Thus, to close the contacts 110, 120 from the off position, a user simply moves the handle assembly 400 back to the on position without having to move to the reset position. As the user moves the handle assembly 400 to the on position, the direction of the bias primary spring 232 causes the second link 224 to move away from the handle member 404 thereby moving the moving arm 122 toward the fixed contact 110 and returning the contacts 110, 120 to the first, closed position.

Figure 14:
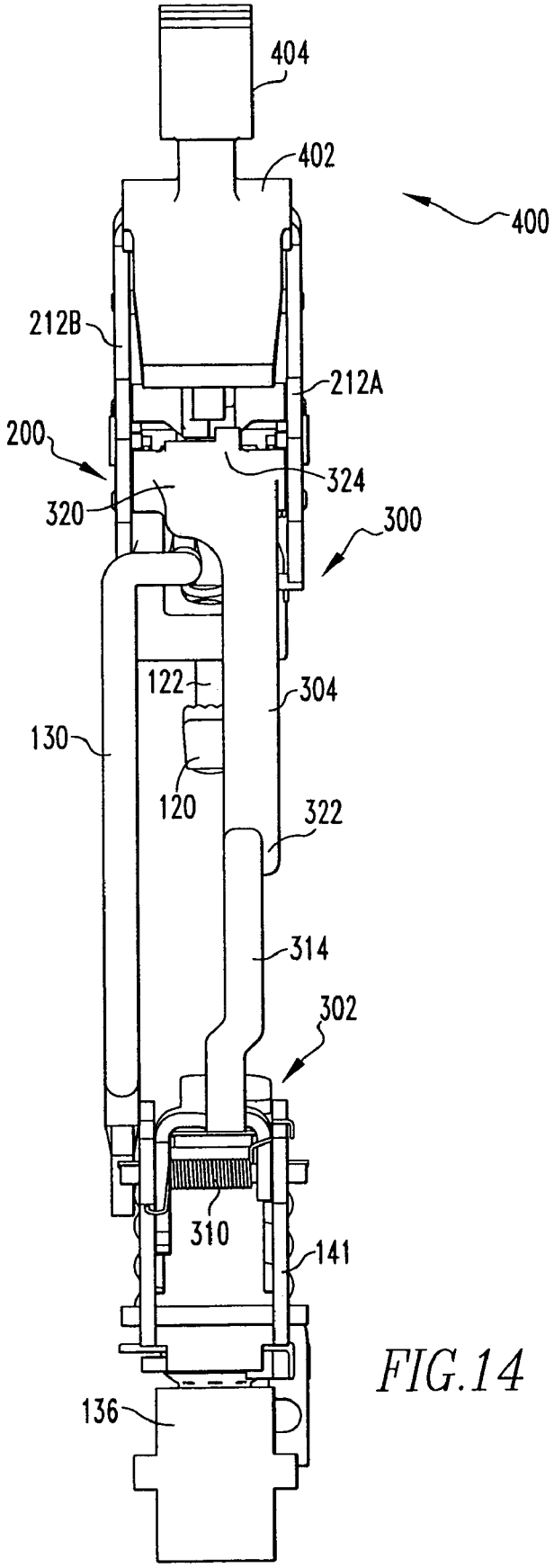
FIG. 14 is a detailed end view of the trip device of FIG. 5 in the tripped position.
Figure 15:
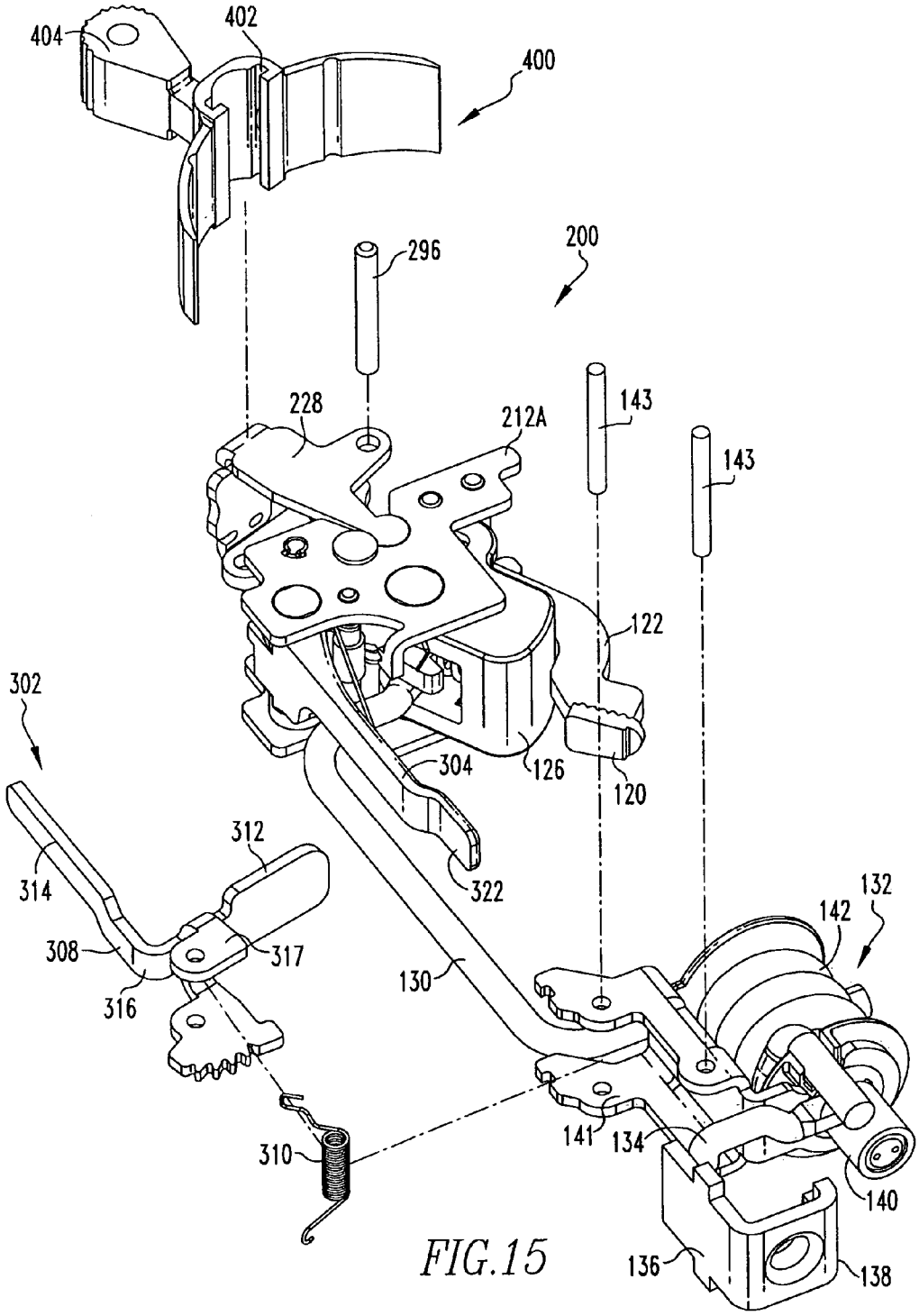
FIG. 15 is a partially exploded view of the trip device and handle assembly of the circuit breaker.

As shown in FIGS. 13 and 14, the trip device 300 is disposed in the housing assembly 20 and structured to selectively engage the operating mechanism 200 so that, during normal operation the movement of the operating mechanism 200 is arrested and during an over-current condition, the operating mechanism 200 moves the contacts 110, 120 from the first position to the second position. The trip device 300 includes an armature assembly 302, a trip bar 304, an intermediate latch 306 and one or more springs 390. As shown in FIG. 15, the armature assembly 302 includes an armature 308 and an armature return spring 310. The armature 308 is acted upon by the magnetic force created by the coil assembly 132. In the embodiment shown, the axis of the coil assembly 132 extends in a direction generally parallel to the longitudinal axis of the housing assembly 20 and the armature 308 is an elongated, bent member. That is, the armature 308 has a first portion 312 and a second portion 314 wherein the first and second portions 312,314 are joined at a vertex 316 at an angle of about ninety degrees. A tab 317 with a pivot opening adjacent to the armature vertex 316 is structured to be pivotally coupled to the coil assembly frame 141. The armature first portion 312 is made from a magnetically affective material, that is, a material that is affected by magnetic fields, such as steel. The armature first portion 312 extends from the armature vertex 316 to a location adjacent to the coil assembly spool 140. The armature second portion 314 extends toward the trip bar 304.

Figure 16:
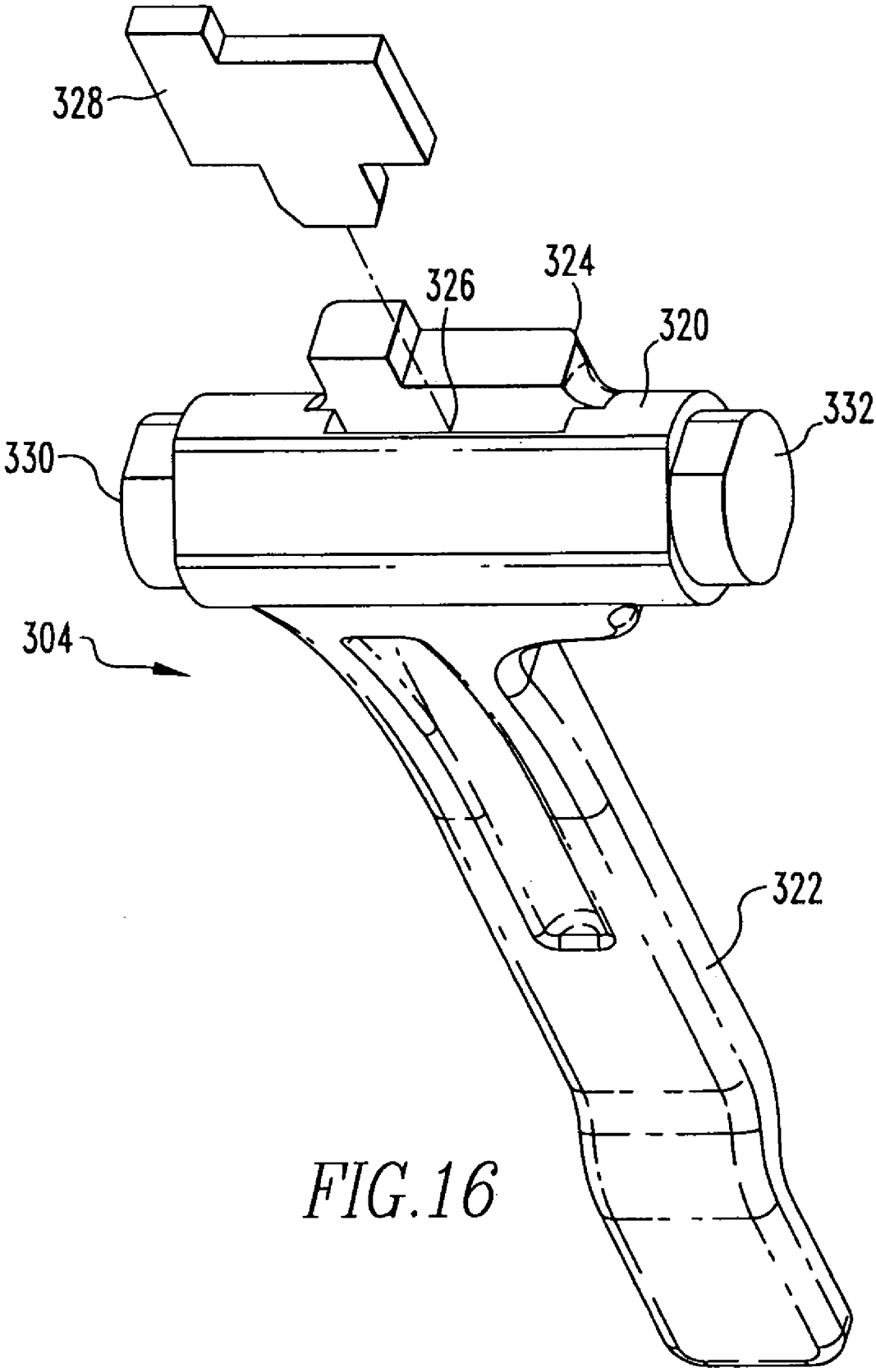
FIG. 16 is an exploded view of the trip bar.

As shown in FIG. 16, the trip bar 304 includes a generally cylindrical body 320, an actuator arm 322 extending generally radially from the trip bar body 320, and a latch extension 324 extending generally radially from the trip bar body 320. In the embodiment shown in the Figures, the actuator arm 322 and the latch extension 324 extend in generally opposite directions. The trip bar body 320 also includes two axial hubs 330, 332. The hubs 330, 332 are generally cylindrical and, preferably, have a diameter that is smaller than the diameter of the trip bar body 320. The hubs 330, 332 are structured to be rotatably disposed in opposed trip bar openings 243A, 243B (FIG. 11) on the operating mechanism side plates 212A, 212B. The latch extension 324 also includes a pocket 326 and a latch plate 328. The latch plate 328 is disposed partially in the pocket 326 and has an external portion having the same general shape as the latch extension 324. The latch plate 328 is, preferably, made from a durable metal.

Figure 17:
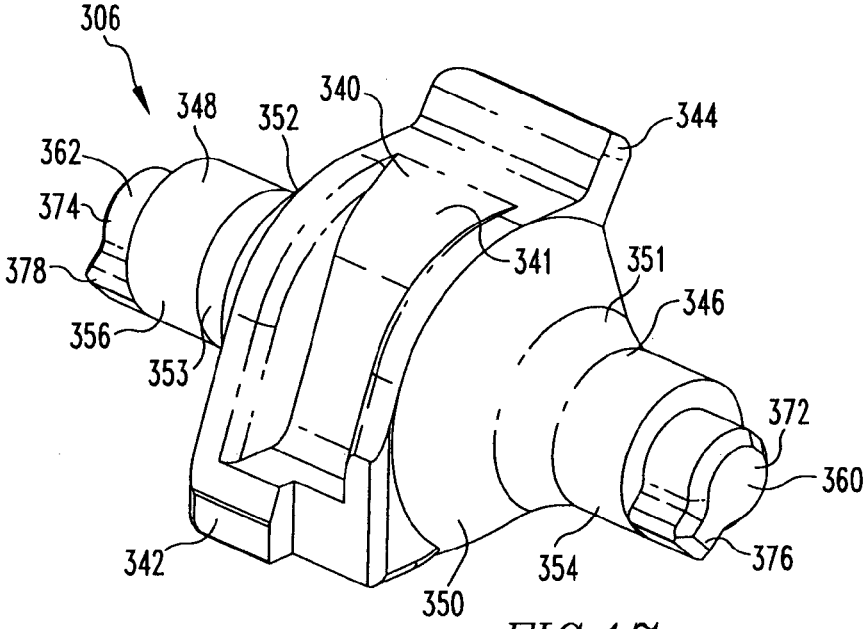
FIG. 17 is an isometric top view of the intermediate latch.
Figure 18:
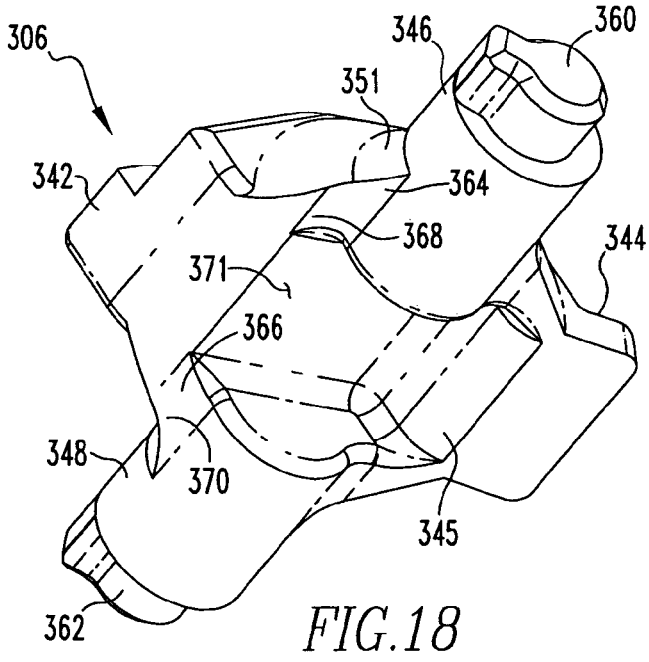
FIG. 18 is an isometric bottom view of the intermediate latch.

As shown in FIGS. 17 and 18, the intermediate latch 306 includes a body 340, which is preferably made from die cast metal, having a central portion 341 with an extending trip bar latch member 342, a cradle guide 344 and at least one, and preferably two, two axle members 346, 348. The axle members 346, 348 extend in generally opposite directions from the body central portion 341. Each axle member 346, 348 includes a partial hub 350, 352, a cylindrical member 354, 356 and a keyed hub 360, 362. Each partial hub 350, 352 is a tapered arcuate member having a thicker, axial base portion 364, 366 adjacent to the cylindrical member 354, 356 which tapers radially to a thinner, edge portion 368, 370. That is, the cylindrical members 354, 356 extend from the associated partial hub base portion 364, 366. Preferably, the partial hub axial base portion 364, 366 has a thickness of between about 0.045 and 0.075 inch and, more preferably, about 0.060 inch. The partial hub edge portion 368, 370 has a thickness of between about 0.025 and 0.065 inch and, more preferably, about 0.032 inch on a first end, which is disposed adjacent to the cradle 220, and about 0.060 inch on a second end, which is disposed adjacent to the trip bar 304. Between each cylindrical member 354, 356 and the associated partial hub 350, 352 is a transition portion 351, 353. The transition portions 351, 353 are arcuate members extending, generally, over the same arc as the partial hubs 350, 352 and extend at an angle between the cylindrical member 354, 356 and the associated partial hub 350, 352. In this configuration, the transition portions 351,353 act to reinforce the joint between the cylindrical member 354, 356 and the associated partial hub 350, 352. The cylindrical members 354, 356 have a diameter that is smaller than the partial hubs 350, 352 and extend in opposite directions, generally from the axis of the partial hubs 350, 352. Thus, the cylindrical members 354, 356 are disposed in a spaced relation and separated by the central portion 341. Further, the cylindrical members 354, 356 form a bifurcated axle for the intermediate latch 306. In between the cylindrical members 354, 356 is a cradle passage 371 sized to allow the cradle 220 to pass therethrough.

The distal end of each cylindrical member 354, 356 terminates in the keyed hub 360, 362. Each keyed hub 360, 362 includes a generally circular portion 372, 374 and a radial extension 376, 378. The keyed hub 360, 362 is structured to be disposed in a keyed opening 241A, 241B (FIG. 11) on the operating mechanism side plates 212A, 212B. The trip bar latch member 342 extends outwardly from the latch body 340 and beyond the partial hubs 350, 352. The trip bar latch member 342 is structured to engage the trip bar 304 (FIG. 13). The cradle guide 344 has an inner edge, adjacent to the cradle passage 371, structured to engage the operating mechanism 200 and is hereinafter identified as the operating mechanism latch 345.

The trip device 300 is assembled as follows. The armature vertex tab 317 (FIG. 15) is pivotally coupled to the coil assembly frame 141. As shown in FIGS. 13 and 14, the armature first portion 312 extends from the armature vertex 316 to a location adjacent to the coil assembly spool 140. The armature second portion 314 extends toward the trip bar 304. The armature return spring 310 is structured to bias the armature first portion 312 away from the coil assembly 132. In this configuration, the armature 308 may pivot over a partial arc indicated by the arrow 309 in FIG. 13. That is, when an over-current condition occurs, the magnetic field generated by the coil assembly 132 overcomes the bias of the armature return spring 310 and the armature 308 pivots with the armature first portion 312 moving toward the coil assembly 132 and the armature second portion 314 moving toward the trip bar actuator arm 322 as described below.

The trip bar 304 is rotatably coupled to the cage 210 with hubs 330, 332 disposed in opposed trip bar openings 243A, 243B. The actuator arm 322 extends away from the handle member 404 towards the armature second portion 314 and into the path of travel thereof. In this configuration, the trip bar 304 is structured to be rotated when engaged by the armature second portion 314. A trip bar spring 391 biases the trip bar 304 to a first, on position. When acted upon by the armature 308, the trip bar 304 rotates to a second, trip position (FIG. 6). Thus, the trip bar 304 is structured to move between two positions: a first generally horizontal position, wherein the latch extension 324 extends generally horizontal, and a second position, wherein, the actuator arm 322 having been engaged by the armature second portion 314, the actuator arm 322 and the latch extension 324 are rotated counter-clockwise, as shown in FIG. 6. That is, the latch extension 324 is rotated away from the operating mechanism 200.

The intermediate latch 306 is coupled to the cage 210 with a keyed hub 360, 362 rotatably disposed in a keyed opening 241A, 241B on each side plate 212A, 212B. As the intermediate latch 306 is rotated, the trip bar latch member 342 has an arcuate path of travel. The intermediate latch 306 is disposed just above the trip bar 304 so that the path of travel of the trip bar latch member 342 extends over the latch extension 324 and with the cradle passage 371 aligned with the cradle 220. In this configuration, when the operating mechanism 200 is in the on position, the cradle 220 is disposed within the cradle passage 371 with the cradle latch edge 278 engaging the operating mechanism latch 345. As noted above, the primary spring 232 biases the cradle 220 toward the handle member 404. Thus, the bias of the cradle 220 biases the intermediate latch 306 to rotate counter-clockwise as shown in FIG. 5; however, when the trip bar 304 is in the normal operating position, the latch extension 324, and more preferably the latch plate 328, engages the trip bar latch member 342 thereby preventing the intermediate latch 306 from rotating. This configuration is the normal operating configuration when the circuit breaker 10 and the operating mechanism 200 are in the on position and the separable contacts 105 are closed.

Figure 7:
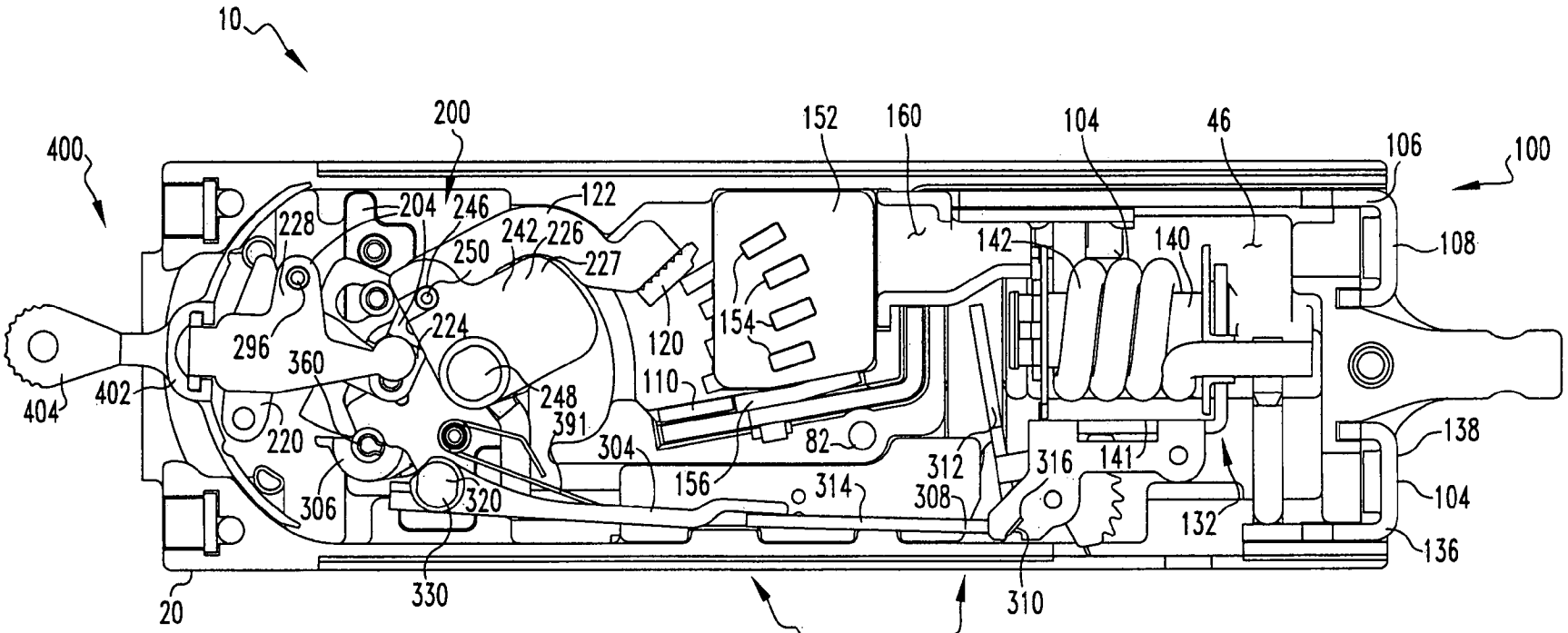
FIG. 7 is a side view of the circuit breaker of FIG. 1 with a housing half shell removed, the operating mechanism cage side plate removed and showing the circuit breaker in the tripped position.
Figure 8:
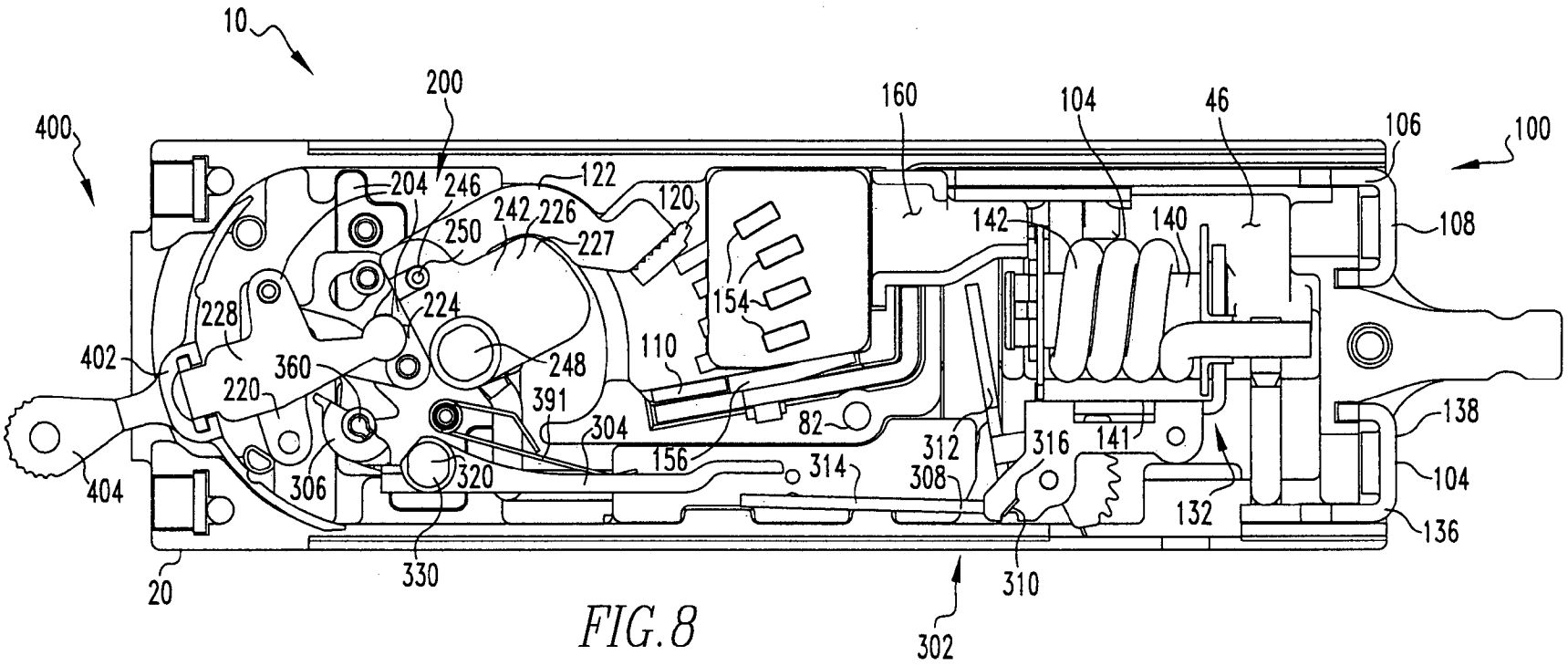
FIG. 8 is a side view of the circuit breaker of FIG. 1 with a housing half shell removed, the operating mechanism cage side plate removed and showing the circuit breaker in the off position.
Figure 9:
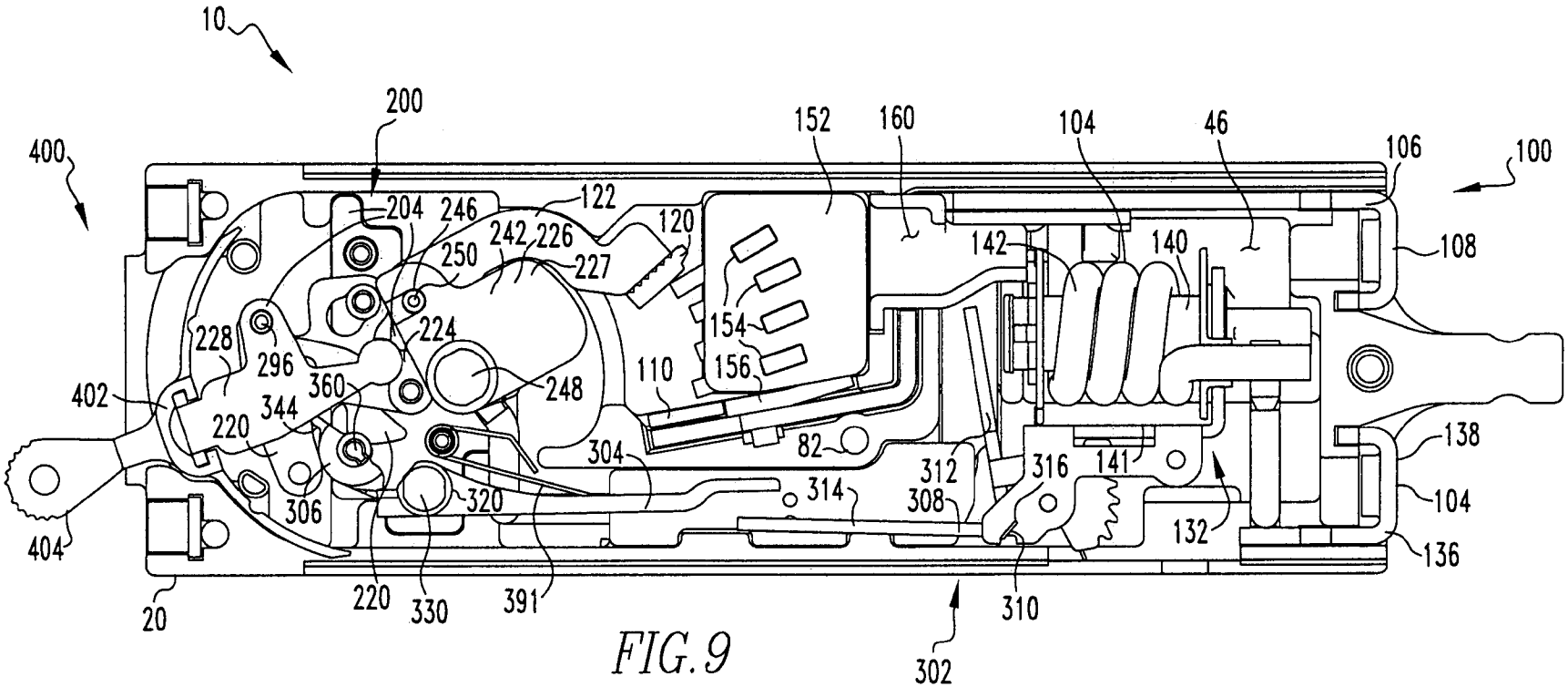
FIG. 9 is a side view of the circuit breaker of FIG. 1 with a housing half shell removed, the operating mechanism cage side plate removed and showing the circuit breaker in the reset position.
Figure 10:
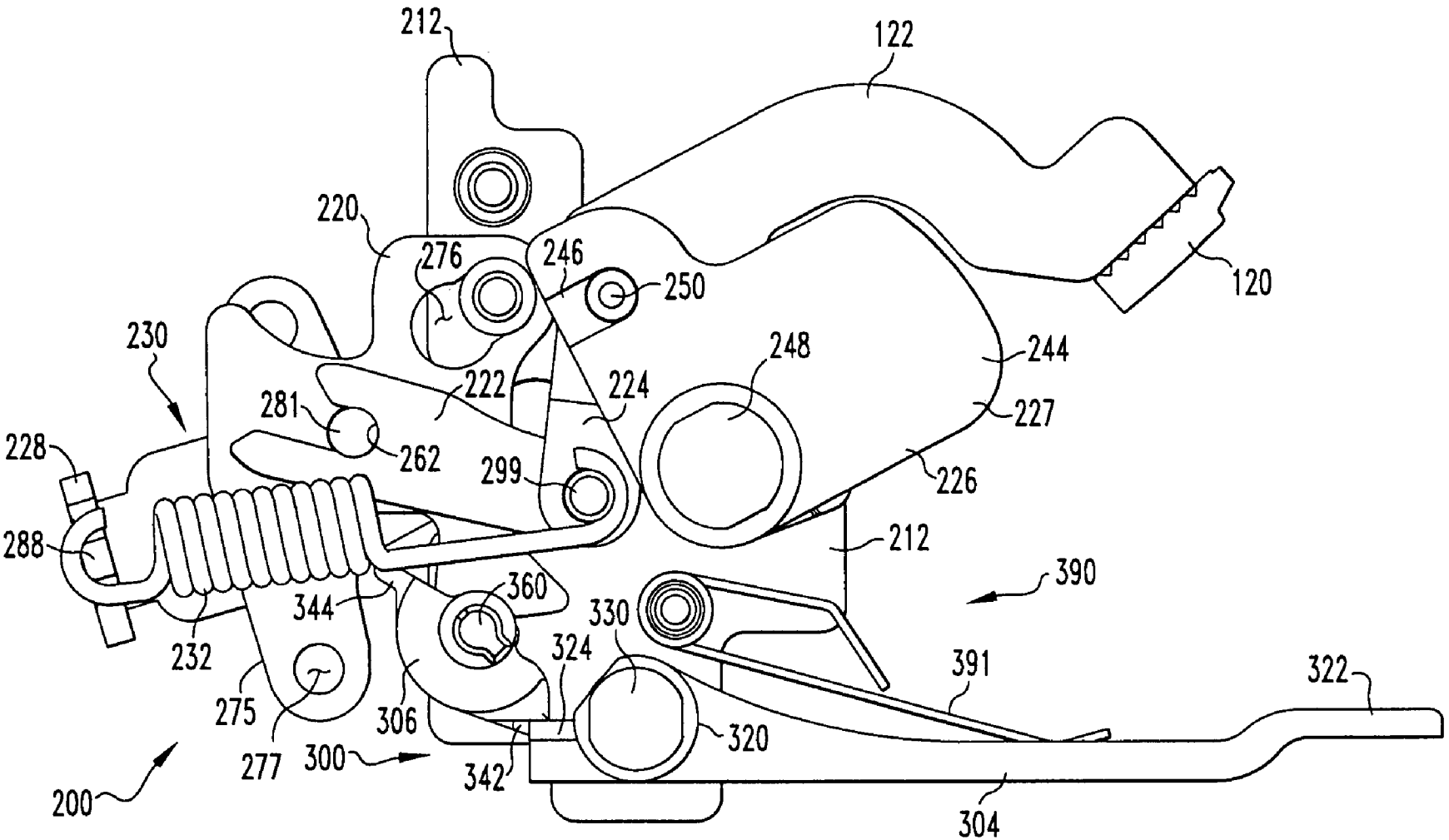
FIG. 10 is a detail side view of the operating mechanism for the circuit breaker in the off position.

When an over-current condition occurs, the coil assembly 132 creates a magnetic field sufficient to overcome the bias of the armature return spring 310. As shown in FIG. 6, when the bias of the armature return spring 310 is overcome, the armature 308 rotates in a clockwise direction so that the armature second portion 314 engages and moves the actuator arm 322. Movement of the actuator arm 322 causes the trip bar 304 to rotate in a counter-clockwise direction until the latch extension 324 (FIG. 16) disengages the trip bar latch member 342 (FIG. 17). Once the trip bar latch member 342 is released, the intermediate latch 306 is free to rotate. Thus, the bias of the primary spring 232 causes the cradle 220 to move toward the handle member 404 and disengage the operating mechanism latch 345 (FIG. 18). At this point, and as shown in FIG. 7, the operating mechanism 200 moves into the trip position as described above, thereby separating the contacts 110, 120 as a result of the over-current condition. As also noted above, when the operating mechanism 200 is moved into the reset position, shown in FIG. 9, the cradle 220 re-engages the trip device 300. More specifically, when the operating mechanism 200 is moved into the reset position, the cradle 220 is moved away from the handle member 404 into the cradle passage 371 until the cradle latch edge 278 is to the right, as shown in FIG. 9, of the operating mechanism latch 345 (FIG. 18). As shown in FIGS. 7 and 9, as the cradle 220 is moved away from the handle member 404, the cradle latch edge 278 engages the cradle guide 344 (FIG. 17) on the intermediate latch 306 and causes the intermediate latch 306 latch to rotate in a clockwise direction, as shown in FIG. 9. The motion on the intermediate latch 306 returns the trip bar latch member 342 to a generally horizontal position. The trip bar 304 may be momentarily displaced as the trip bar latch member 342 moves past the trip bar, then the trip bar spring 391 returns the trip bar 304 to the trip bar first position. Thus, the trip bar latch extension 324 is repositioned to the right, as shown in FIG. 9, of the trip bar latch member 342. As pressure on the handle assembly 400 is released and the operating mechanism 200 returns to the on position, the primary spring 232 biases the cradle 220 toward the handle member 404 so that the cradle latch edge 278 reengages the operating mechanism latch 345 (FIG. 18). Thus, as set forth above, the bias of the cradle 220 biases the intermediate latch 306 to rotate counter-clockwise so that the trip bar latch member 342 contacts the trip bar latch extension 324, and more preferably the latch plate 328. When the trip bar 304 is reengaged by the intermediate latch 306 and movement of the operating mechanism 200 is arrested, the circuit breaker 10 is again in the on position.

As shown in FIG. 15, the handle assembly 400 includes a base member 402 and a handle member 404. The handle assembly base member 402 is coupled to the handle arm 228 of the operating mechanism 200. When the circuit breaker 10 is fully assembled, the handle member 404 extends through the handle member opening 52 (FIG. 1). Accordingly, a user may manipulate the position of the operating mechanism 200 by moving the handle member 404. The housing assembly 20 may include indicia that indicate that a certain handle member 404 position corresponds to a certain operating mechanism 200 position. Moreover, the handle assembly base member 402 may include a color indicia, typically a bright red, at a selected location that is within the housing assembly 20 when the operating mechanism 200 is in the on position, but is visible through the handle member opening 52 when the operating mechanism 200 is in the tripped, off, or reset positions. Thus, a user may visually determine if the circuit breaker 10 is closed or open.

Figure 19:
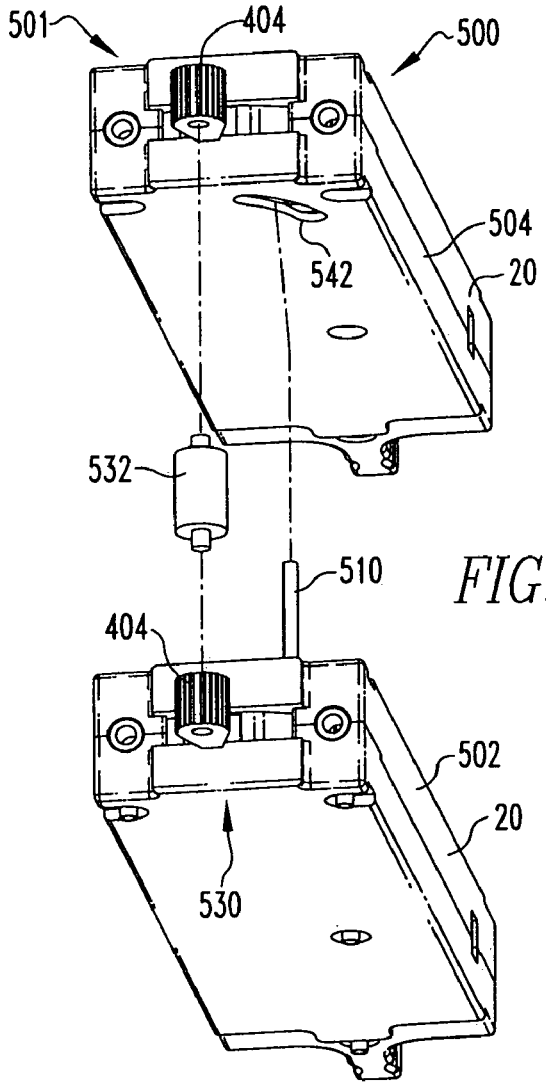
FIG. 19 is an isometric, exploded view of two operatively coupled circuit breakers.
Figure 20:
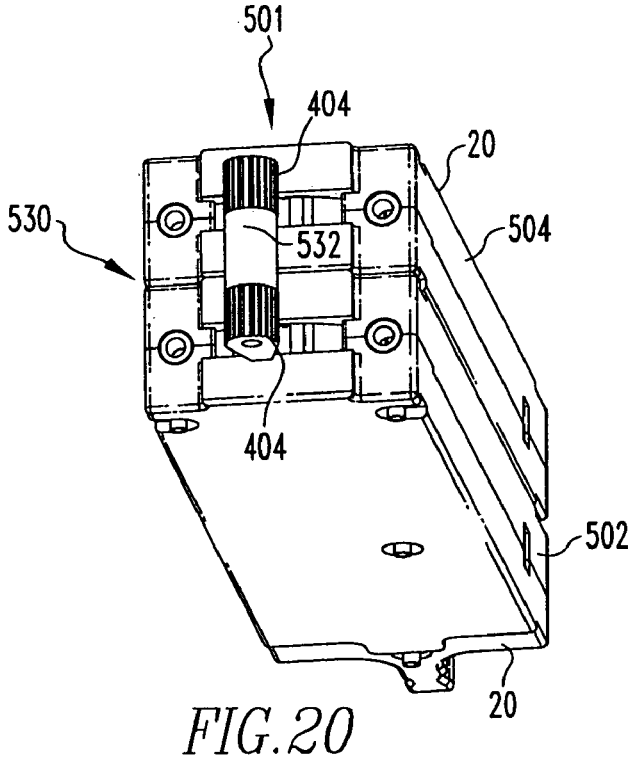
FIG. 20 is an isometric view of two operatively coupled circuit breakers.

In certain situations two, or more, circuit breakers 10 may be operatively linked by a shared tripping device 500. That is, as shown in FIGS. 19 and 20, a pair of operatively coupled circuit breakers 501 includes a primary circuit breaker 502 and at least one secondary circuit breaker 504. It is understood that the primary circuit breaker 502 and the at least one secondary circuit breaker 504 are, except where noted below, are substantially similar to the circuit breaker 10 detailed above. As such, like reference numbers will be used in reference to the components of the primary circuit breaker 502 and the at least one secondary circuit breaker 504. These components are shown in FIGS. 1-18.

The shared tripping device 500 is structured to operatively couple the two circuit breakers 502, 504 so that when the primary circuit breaker contacts 110, 120 are in the open position, the secondary circuit breaker contacts 110, 120 are also in the open position. Similarly, when the primary circuit breaker contacts 110, 120 are in the closed position, the secondary circuit breaker contacts 110, 120 are also in the closed position. The shared tripping device 500 includes an inter-phase link 510 (FIG. 19) on the primary circuit breaker 502 and a trip lever 520 (FIG. 22) on the secondary circuit breaker 504.

The housing assembly 20 of the primary circuit breaker 502 and the secondary circuit breaker 504 each include a shaped opening 540 (FIG. 21), 542 (FIG. 19), respectively. The shaped opening corresponds to the path of travel of the inter-phase link 510, as described below. As shown in FIG. 20, the primary and secondary circuit breakers 502, 504 are disposed adjacent to each other. In this configuration, the shaped openings 540 (FIG. 21), 542 (FIG. 19) mirror each other and are disposed immediately adjacent to each other.

Figure 21:
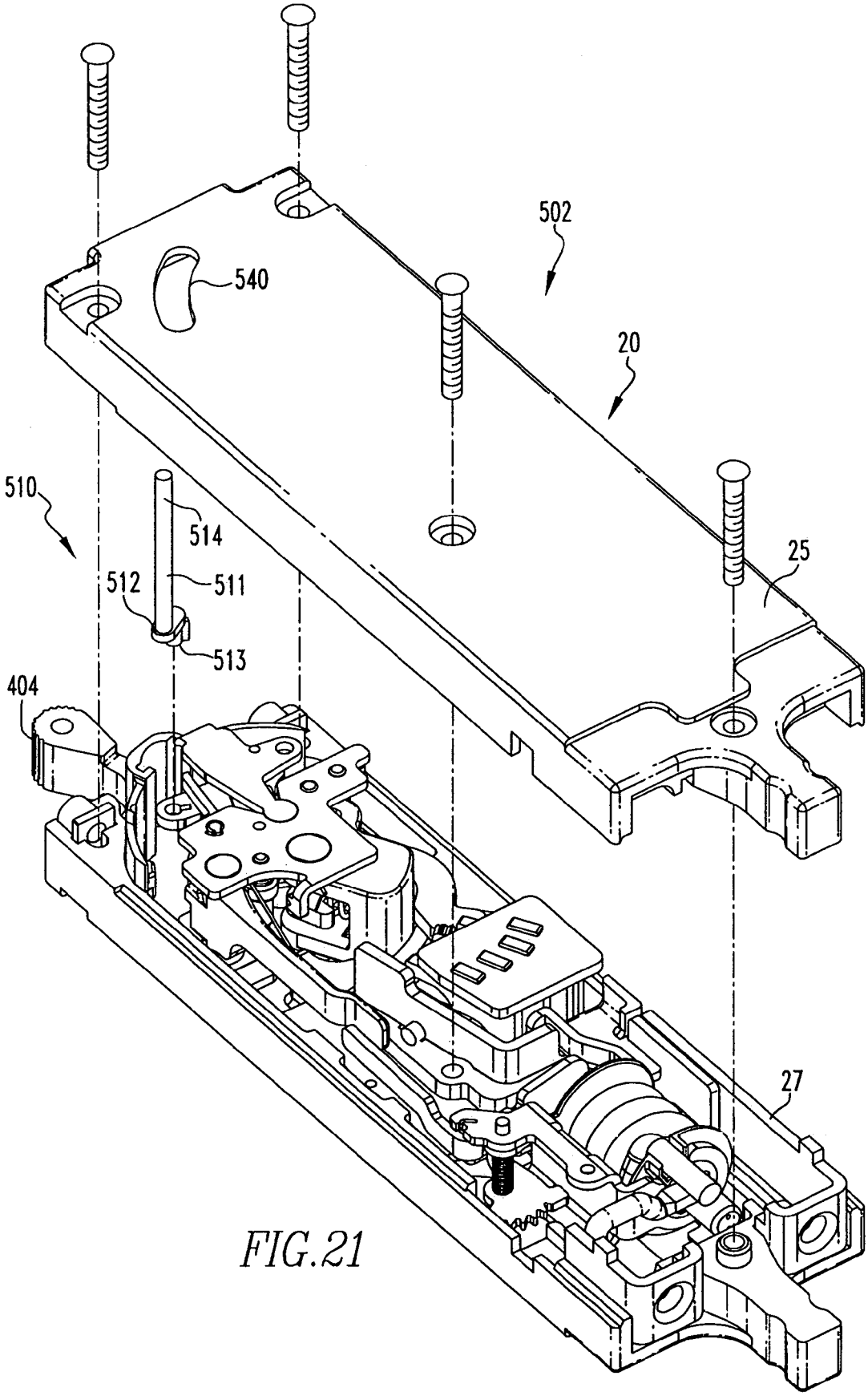
FIG. 21 is an exploded view of a primary circuit breaker.

As shown on FIG. 21, the inter-phase link 510 includes an elongated body 511 having a mounting end 512 and a distal end 514. The inter-phase link mounting end 512 includes a mounting peg 513. The mounting peg 513 is structured to be fixedly coupled to the operating mechanism 200 on the primary circuit breaker 502. Preferably, the mounting peg 513 is structured to be coupled to the inter-phase link opening 277 on the inter-phase link extension 275. As the cradle 220 is structured to move in a generally arcuate path, the inter-phase link 510 has a generally arcuate path of travel. The inter-phase link distal end 514 is structured to extend through the shaped opening 540 of the primary circuit breaker 502 housing assembly 20 and through the shaped opening 542 (FIG. 19) of the secondary circuit breaker 504 housing assembly 20 and into the secondary circuit breaker 504 enclosed space 46. Thus, the distal end 514 may engage the trip device 300 of the secondary circuit breaker 504. The inter-phase link body 511 has a length of between about 0.500 and 1.0 inch, and more preferably about 0.650 inch.

Figure 22:
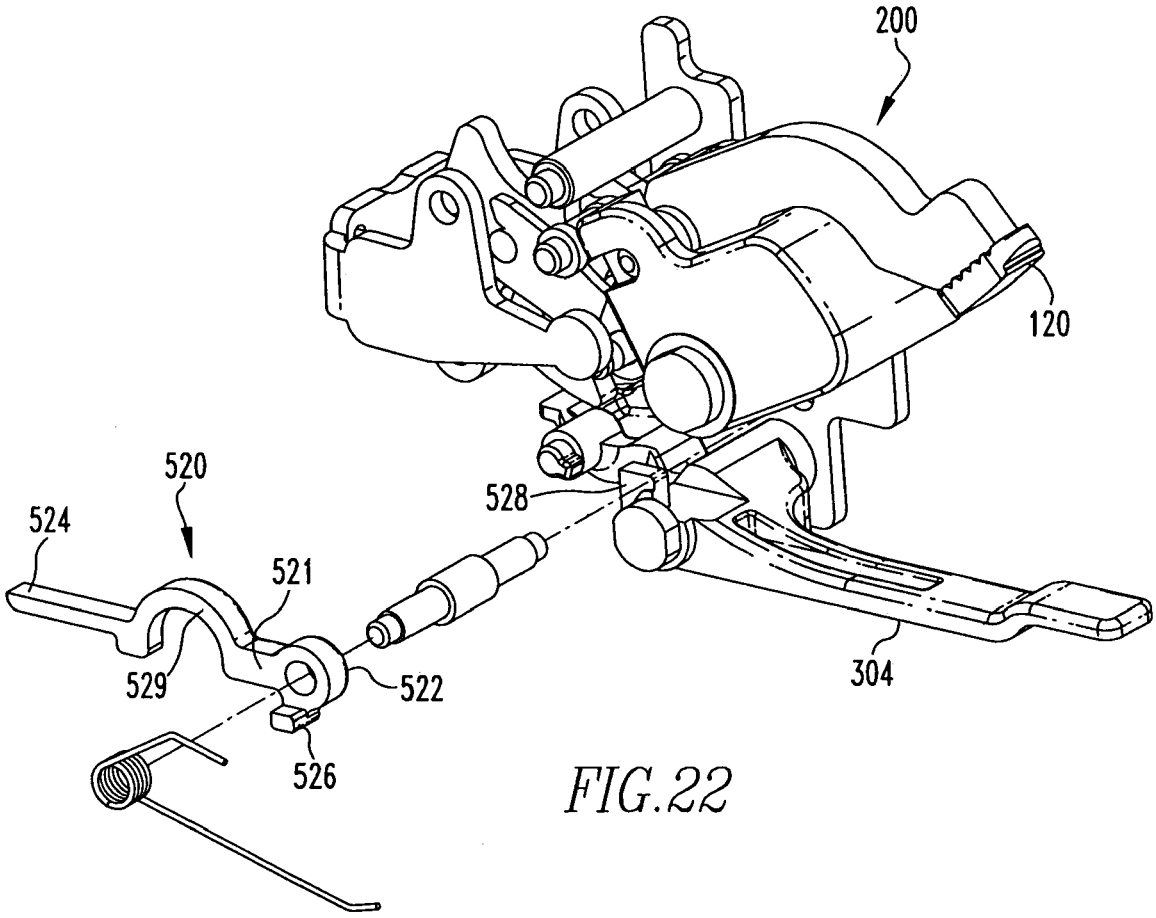
FIG. 22 is an exploded isometric view of the secondary circuit breaker operating mechanism.

As shown in FIG. 22, the secondary circuit breaker 504 trip device 300 includes the trip lever 520. The trip lever 520 includes an elongated body 521 that has two ends, a mounting end 522 and a distal end 524. The trip lever mounting end 522 also includes a trip bar tab 526. The trip bar tab 526 extends, preferably, in a direction parallel to the axis of rotation of the trip lever 520. In this embodiment, the secondary circuit breaker trip bar 304 includes a trip lever tab 528 which extends from the trip bar cylindrical body 320. The trip lever mounting end 522 is structured to be pivotally coupled to the cage 210 adjacent to the trip bar cylindrical body 320. The trip bar tab 526 and the trip lever tab 528 are structured to engage each other so that rotation of the trip lever 520 imparts a counter-clockwise, as shown in FIG. 22, rotation to the trip bar 304. As detailed above, such a rotation of the trip bar 304 will cause the trip device 300 to actuate the operating mechanism 200 and move the contacts 110, 120 to the open position. That is, actuating the trip bar 304 will trip the circuit breaker 10. The trip lever distal end 524 extends into the path of travel of the inter-phase link distal end 514. The trip lever body 521 has a length of between about 0.5 and 1.0 inch, and more preferably about 0.82 inch. The trip lever body 521 may include an arcuate portion 529. The arcuate portion 529, or another shaped bend, allows the trip lever body 521 to fit within the enclosed space 46 without interfering with other components.

When the shared trip device 500 is assembled, the inter-phase link 510 is coupled to the primary circuit breaker cradle 220 with the inter-phase link distal end 514 extending into the secondary circuit breaker enclosed space 46. The trip lever mounting end 522 is pivotally coupled to the cage 210 adjacent to the trip bar cylindrical body 320 with the trip lever distal end 524 extending into the path of travel of the inter-phase link distal end 514. In this configuration the movement of the primary circuit breaker 502 operating mechanism 200 when tripped will cause the inter-phase link 510 to move. When the inter-phase link 510 moves, the inter-phase link distal end 514 engages the trip lever distal end 524, thereby actuating the trip device 300 of the secondary circuit breaker 504. When the trip device 200 of the secondary circuit breaker 504 is actuated, the secondary circuit breaker 504 trips, thereby separates the contacts 110, 120 of the secondary circuit breaker 504. Accordingly, when the primary circuit breaker 502 is in an open position, the secondary circuit breaker 504 is also in an open position.

Just as the operatively coupled circuit breakers 501 are moved into the open position together, it is desirable to move the operatively coupled circuit breakers 501 into the closed position together. Accordingly, as shown in FIGS. 19 and 20, the operatively coupled circuit breakers 501 may also includes a joined handle 530. That is, each circuit breaker 502, 504 has a handle member 404 extending from the housing assembly 20. As detailed above, each handle member 404 moves with the associated operating mechanism 200 when the circuit breaker 502, 504 is tripped, or moved when actuated by a user. A handle link 532 may extend between, and be coupled to, the two circuit breaker handle members 404. Thus, when a user moves one handle member 404, to the reset position, for example, both circuit breaker operating mechanisms 200 move in tandem.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limited as to the scope of invention which is to be given the full breadth of the claims appended and all equivalents thereof.

What is claimed is:

1. A shared tripping device structured to operatively couple at least two circuit breakers, a primary circuit breaker and a secondary circuit breaker, each circuit breaker having a current path assembly with a pair of separable contacts, a fixed contact and a movable contact, an operating mechanism, a tripping device, a handle assembly and a housing assembly, each said operating mechanism disposed in said housing assembly and structured to move said pair of separable contacts between a first, closed position, wherein said contacts are in electrical communication, and a second, open position, wherein said contacts are separated, thereby preventing electrical communication therebetween, each said operating mechanism including a cage, a cradle and at least one primary spring, said cradle coupled to said movable contact, said spring engaging said cradle and biasing said operating mechanism to move said separable contacts to said open position, each said tripping device structured to arrest the movement of said operating mechanism, thereby allowing said contacts to be maintained in the closed position, each said tripping device further being responsive to an over current condition wherein said tripping device releases said operating mechanism and allows said primary spring to move said cradle along a path of travel and thereby separate said contacts, said secondary circuit breaker tripping device having a pivoting trip bar with a trip lever tab, each said housing assembly has a shaped opening, each handle assembly having a handle member coupled to said operating mechanism and extending from said housing assembly, said shared tripping device comprising:

an inter-phase link coupled to said primary circuit breaker and a trip lever coupled to said secondary circuit breaker, said inter-phase link having an elongated body with a mounting end and a distal end;

said inter-phase link body mounting end coupled to said primary circuit breaker operating mechanism whereby said inter-phase link is structured to move along a path of travel corresponding to said path of travel of said cradle as said cradle moves; and said inter-phase link body distal end extending through said primary circuit breaker housing assembly shaped opening and said secondary circuit breaker housing assembly shaped opening and engaging said secondary circuit breaker trip device.

2. The shared tripping device of claim 1 wherein said primary circuit breaker cradle includes an inter-phase link extension having an inter-phase link opening, and wherein:

said inter-phase link body mounting end includes a mounting peg, said mounting peg structured to be coupled to said inter-phase link opening.

3. The shared tripping device of claim 1 wherein said inter-phase link body has a length between about 0.5 and 1.0 inch.

4. The shared tripping device of claim 1 wherein said inter-phase link body has a length of about 0.65 inch.

5. The shred tripping device of claim 2 wherein:

said trip lever includes a body having a mounting end and a distal end;

said trip lever body mounting end pivotally coupled to said cage and engaging said secondary circuit breaker trip bar;

said trip lever body distal end disposed in said path of travel of said inter-phase link body distal end; and wherein said trip lever body distal end is structured to be engaged by said inter-phase link body distal end as said inter-phase link body distal end moves along said path of travel and said trip lever is structured to actuate said secondary circuit breaker trip bar when said trip lever is engaged by said inter-phase link body distal end.

6. The shred tripping device of claim 5 wherein said trip lever body mounting end includes a trip bar tab, said trip bar tab structured to engage said trip bar trip lever tab.

7. The shared tripping device of claim 2 further including a handle link extending between said primary circuit breaker handle member and said secondary circuit breaker handle member.

8. A pair of operatively linked circuit breakers comprising:

a primary circuit breaker having a current path assembly with a pair of separable contacts, a fixed contact and a movable contact, an operating mechanism, a tripping device, a handle assembly and a housing assembly, said primary circuit breaker operating mechanism disposed in said primary circuit breaker housing assembly and structured to move said primary circuit breaker pair of separable contacts between a first, closed position, wherein said primary circuit breaker contacts are in electrical communication, and a second, open position, wherein said primary circuit breaker contacts are separated, thereby preventing electrical communication therebetween, said primary circuit breaker operating mechanism including a cage, a cradle and at least one primary spring, said primary circuit breaker cradle coupled to said primary circuit breaker movable contact, said primary circuit breaker spring engaging said primary circuit breaker cradle and biasing said primary circuit breaker operating mechanism to move said primary circuit breaker separable contacts to said open position, said primary circuit breaker tripping device structured to arrest the movement of said primary circuit breaker operating mechanism, thereby allowing said primary circuit breaker contacts to be maintained in the closed position, said primary circuit breaker tripping device further being responsive to an over current condition wherein said primary circuit breaker tripping device releases said primary circuit breaker operating mechanism and allows said primary circuit breaker primary spring to move said primary circuit breaker cradle along a path of travel and thereby separate said primary circuit breaker contacts, said primary circuit breaker housing assembly having a shaped opening, said primary circuit breaker handle assembly having a handle member coupled to said primary circuit breaker operating mechanism and extending from said primary circuit breaker housing assembly;

a secondary circuit breaker having a current path assembly with a pair of separable contacts, a fixed contact and a movable contact, an operating mechanism, a tripping device, and a housing assembly, said secondary circuit breaker operating mechanism disposed in said secondary circuit breaker housing assembly and structured to move said secondary circuit breaker pair of separable contacts between a first, closed position, wherein said secondary circuit breaker contacts are in electrical communication, and a second, open position, wherein said secondary circuit breaker contacts are separated, thereby preventing electrical communication therebetween, said secondary circuit breaker operating mechanism including a cage, a cradle and at least one secondary spring, said secondary circuit breaker cradle coupled to said secondary circuit breaker movable contact, said secondary circuit breaker spring engaging said secondary circuit breaker cradle and biasing said secondary circuit breaker operating mechanism to move said secondary circuit breaker separable contacts to said open position, said secondary circuit breaker tripping device structured to arrest the movement of said secondary circuit breaker operating mechanism, thereby allowing said secondary circuit breaker contacts to be maintained in the closed position, said secondary circuit breaker tripping device further being responsive to an over current condition wherein said secondary circuit breaker tripping device releases said secondary circuit breaker operating mechanism and allows said secondary circuit breaker secondary spring to move said secondary circuit breaker cradle along a path of travel and thereby separate said secondary circuit breaker contacts, said secondary circuit breaker tripping device having a pivoting trip bar with a trip lever tab, said secondary circuit breaker housing assembly having a shaped opening, said secondary circuit breaker handle assembly having a handle member coupled to said secondary circuit breaker operating mechanism and extending from said secondary circuit breaker housing assembly;

a shared tripping device having an inter-phase link coupled to said primary circuit breaker and a trip lever coupled to said secondary circuit breaker;

said inter-phase link having an elongated body with a mounting end and a distal end;

said inter-phase link body mounting end coupled to said primary circuit breaker operating mechanism whereby said inter-phase link is structured to move along a path of travel corresponding to said path of travel of said cradle as said cradle moves; and said inter-phase link body distal end extending through said primary circuit breaker housing assembly shaped opening and said secondary circuit breaker housing assembly shaped opening and engaging said secondary circuit breaker trip device.

9. The operatively linked circuit breakers of claim 8 wherein said primary circuit breaker cradle includes an inter-phase link extension having an inter-phase link opening, and wherein:

said inter-phase link body mounting end includes a mounting peg, said mounting peg structured to be coupled to said inter-phase link opening.

10. The operatively linked circuit breakers of claim 8 wherein said inter-phase link body has a length between about 0.5 and 1.0 inch.

11. The operatively linked circuit breakers of claim 8 wherein said inter-phase link body has a length of about 0.65 inch.

12. The operatively linked circuit breakers of claim 8 wherein:

said trip lever includes a body having a mounting end and a distal end;

said trip lever body mounting end pivotally coupled to said cage and engaging said secondary circuit breaker trip bar;

said trip lever body distal end disposed in said path of travel of said inter-phase link distal end; and wherein said trip lever distal end is structured to be engaged by said inter-phase link body distal end as said inter-phase link body distal end moves along said path of travel and said trip lever is structured to actuate said secondary circuit breaker trip bar when said trip lever is engaged by said inter-phase link distal end.

13. The operatively linked circuit breakers of claim 12 wherein said trip lever body mounting end includes a tip bar tab, said trip bar tab structured to engage said trip bar trip lever tab.

14. The operatively linked circuit breakers of claim 8 further including a handle link extending between said primary circuit breaker handle member and said secondary circuit breaker handle member.

* * * * *